US009482975B2

(12) United States Patent
Yamauchi et al.

(10) Patent No.: US 9,482,975 B2
(45) Date of Patent: Nov. 1, 2016

(54) TONER, DEVELOPER, IMAGE FORMING APPARATUS, AND PROCESS CARTRIDGE

(71) Applicants: Yoshitaka Yamauchi, Shizuoka (JP); Kazumi Suzuki, Shizuoka (JP)

(72) Inventors: Yoshitaka Yamauchi, Shizuoka (JP); Kazumi Suzuki, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/425,199

(22) PCT Filed: Sep. 12, 2013

(86) PCT No.: PCT/JP2013/075384

§ 371 (c)(1),
(2) Date: Mar. 2, 2015

(87) PCT Pub. No.: WO2014/046218

PCT Pub. Date: Mar. 27, 2014

(65) Prior Publication Data

US 2015/0212444 A1 Jul. 30, 2015

(30) Foreign Application Priority Data

Sep. 18, 2012 (JP) ..... 2012-204774
Jul. 30, 2013 (JP) ..... 2013-157297

(51) Int. Cl.
*G03G 9/08* (2006.01)
*G03G 9/087* (2006.01)

(52) U.S. Cl.
CPC ..... *G03G 9/08764* (2013.01); *G03G 9/081* (2013.01); *G03G 9/0821* (2013.01); *G03G 9/0825* (2013.01); *G03G 9/08733* (2013.01); *G03G 9/08755* (2013.01); *G03G 9/08795* (2013.01); *G03G 9/08797* (2013.01)

(58) Field of Classification Search
CPC ..... G03G 9/08755; G03G 9/08764; G03G 9/08795; G03G 9/08797
USPC ..... 430/109.4
See application file for complete search history.

(56) References Cited

U.S. PATENT DOCUMENTS 6,033,819 A 3/2000 Matsui et al.
2005/0208414 A1 9/2005 Nakamura et al.

(Continued)

FOREIGN PATENT DOCUMENTS

JP 06-258861 9/1994
JP 2765379 4/1998

(Continued)

OTHER PUBLICATIONS

International Search Report Issued Oct. 15, 2013 in PCT/JP13/075384 filed Sep. 12, 2013.

(Continued)

*Primary Examiner* — Mark A Chapman
(74) *Attorney, Agent, or Firm* — Oblon, McClelland, Maier & Neustadt, L.L.P

(57) ABSTRACT

Provided is a toner including a crystalline resin and a non-crystalline resin. In a reflected electron image of a cross-section of the toner stained by ruthenium tetroxide captured by a scanning electron microscope, the ratio of regions stained by ruthenium tetroxide is from 50 area % to 80 area %. In a reflected electron image of the surface of the toner stained by ruthenium tetroxide captured by a scanning electron microscope, the ratio of regions stained by ruthenium tetroxide is from 10 area % to 40 area %.

7 Claims, 3 Drawing Sheets

(56) References Cited

U.S. PATENT DOCUMENTS

| | | | |
|---|---|---|---|
| 2007/0160376 | A1 | 7/2007 | Ishida et al. |
| 2008/0025754 | A1 | 1/2008 | Ishiyama et al. |
| 2013/0130169 | A1 | 5/2013 | Aoki et al. |
| 2013/0157185 | A1 | 6/2013 | Sakashita et al. |

FOREIGN PATENT DOCUMENTS

| | | |
|---|---|---|
| JP | 2001-281909 | 10/2001 |
| JP | 2002-202627 | 7/2002 |
| JP | 2002-221825 | 8/2002 |
| JP | 2003-167384 | 6/2003 |
| JP | 2005-062214 | 3/2005 |
| JP | 2005-266546 | 9/2005 |
| JP | 2005-345975 | 12/2005 |
| JP | 2007-241187 | 9/2007 |
| JP | 2008-033057 | 2/2008 |
| JP | 2012-042939 | 3/2012 |
| JP | 2012-116882 | 6/2012 |
| JP | 2012-155121 | 8/2012 |
| RU | 2 372 635 | 11/2009 |

OTHER PUBLICATIONS

Russian Official Decision on Grant dated Jun. 14, 2016 with English Translation.

TONER, DEVELOPER, IMAGE FORMING APPARATUS, AND PROCESS CARTRIDGE

TECHNICAL FIELD

The present invention relates to a toner, a developer, an image forming apparatus, and a process cartridge.

BACKGROUND ART

Electrophotographic image formation is generally performed in a serial process of forming an electrostatic latent image on a photoconductor, developing the electrostatic latent image with a developer to form a toner image, transferring the toner image to a recording medium such as paper, and fixing it thereon.

As developers, one-component developers made of only either a magnetic toner or a non-magnetic toner, and two-component developers made of a toner and a carrier are known.

A toner image fixing method that is generally employed is a heating roller method of directly pressing and fixing a toner image on the recording medium by a heating roller, because this method is energy-efficient.

The problem is, however, that the heating roller method requires a great amount of electricity to fix a toner image.

Hence, enhancement of toner's low-temperature fixability is required.

PTL 1 discloses an image forming toner that contains a colorant, a binder resin, and a releasing agent, where the binder resin contains two kinds of polyester resins, namely a polyester resin A and a polyester resin B. The polyester A is a crystalline aliphatic polyester resin that has at least one diffraction peak at a position of $2\theta=20°$ to $25°$ in its powder X-ray diffraction pattern. The polyester resin B is a non-crystalline polyester resin that has a softening temperature $[T(F_{1/2})]$ higher than the softening temperature $[T(F_{1/2})]$ of the polyester resin A. The polyester resin A and the polyester resin B are incompatible with each other.

However, it is required to prevent occurrence of toner scattering and background smear.

CITATION LIST

Patent Literature

[PTL 1] Japanese Patent Application Laid-Open (JP-A) No. 2003-167384

SUMMARY OF INVENTION

Technical Problem

In view of the problem of the conventional art, one aspect of the present invention is to provide a toner that has excellent low-temperature fixability, and can prevent occurrence of toner scattering and background smear.

Solution to Problem

In one aspect of the present invention, in a reflected electron image of a cross-section of the toner stained by ruthenium tetroxide captured by a scanning electron microscope, the ratio of regions stained by the ruthenium tetroxide is from 50 area % to 80 area %.

In a reflected electron image of the surface of the toner stained by ruthenium tetroxide captured by a scanning electron microscope, the ratio of regions stained by the ruthenium tetroxide is from 10 area % to 40 area %.

Advantageous Effects of Invention

According to one aspect of the present invention, it is possible to provide a toner that has excellent low-temperature fixability and can prevent occurrence of toner scattering and background smear.

DESCRIPTION OF EMBODIMENTS

Figure 1:
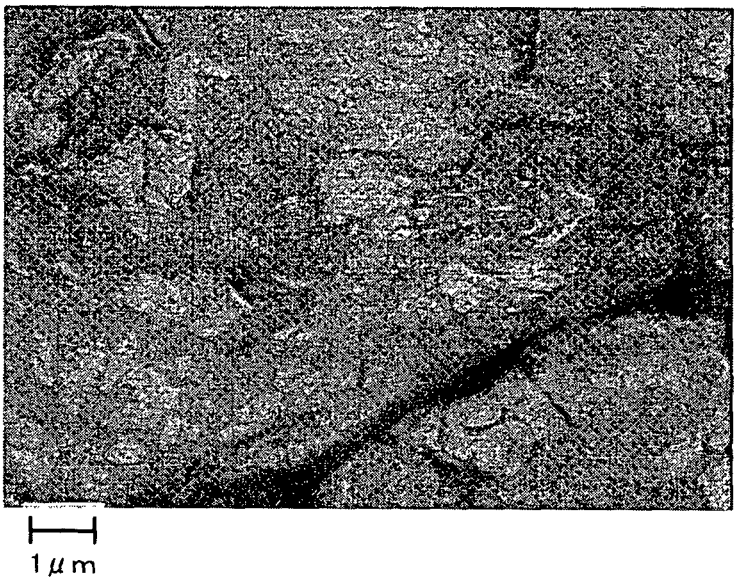
FIG. 1 shows an example of a reflected electron image of the surface of a toner.

Next, an embodiment for carrying out the present invention will be explained with reference to the drawings.

(Toner)

A toner to be disclosed contains a crystalline resin and a non-crystalline resin.

In a reflected electron image of a cross-section of the toner stained by ruthenium tetroxide captured by a scanning electron microscope, the ratio of regions stained by ruthenium tetroxide is from 50 area % to 80 area %, preferably from 60 area % to 75 area %. If the ratio of regions stained by ruthenium tetroxide in the reflected electron image of the cross-section of the toner is less than 50 area %, toner scattering and background smear will occur. If the ratio is greater than 80 area %, the low-temperature fixability of the toner will degrade.

It is possible to calculate the content of the non-crystalline resin in the toner by measuring the ratio of regions stained by ruthenium tetroxide in the reflected electron image of the cross-section of the toner, because the non-crystalline resin contained in the toner is selectively stained by ruthenium tetroxide. The greater the ratio of regions stained by ruthenium tetroxide in the reflected electron image of the cross-section of the toner, the greater the content of the non-crystalline resin in the toner.

In a reflected electron image of the surface of the toner stained by ruthenium tetroxide captured by a scanning electron microscope, the ratio of regions stained by ruthenium tetroxide is from 10 area % to 40 area %, preferably from 20 area % to 30 area %. If the ratio of regions stained by ruthenium tetroxide in the reflected electron image of the surface of the toner is less than 10 area %, toner scattering and background smear will occur. If the ratio is greater than 40 area %, the low-temperature fixability of the toner will degrade.

It is possible to calculate the content of the non-crystalline resin in a region near the surface of the toner by measuring the ratio of regions stained by ruthenium tetroxide in the reflected electron image of the surface of the toner, because the non-crystalline resin contained in the toner is selectively stained by ruthenium tetroxide. The greater the ratio of regions stained by ruthenium tetroxide in the reflected electron image of the surface of the toner, the greater the content of the non-crystalline resin in a region near the surface of the toner.

When a scanning electron microscope is used to capture a reflected electron image of the surface of a toner, it is possible to observe a region near the surface of the toner that reaches a depth of several ten nm from the surface.

The method for staining the non-crystalline resin contained in the toner by ruthenium tetroxide is not particularly limited, but may be to immerse the toner in a ruthenium tetroxide aqueous solution, or to expose the toner to a vaporous atmosphere of a ruthenium tetroxide aqueous solution.

It is possible to calculate the ratio of regions stained by ruthenium tetroxide in the reflected electron images of the cross-section and surface of the toner by image processing.

FIG. 1 shows an example of a reflected electron image of the surface of a toner. In FIG. 1, white portions are regions stained by ruthenium tetroxide. Regions stained by ruthenium tetroxide appear white because electrons can less easily pass through such regions.

It can be seen from FIG. 1 that the content of the crystalline-resin in a region near the surface of the toner is large.

Figure 2:
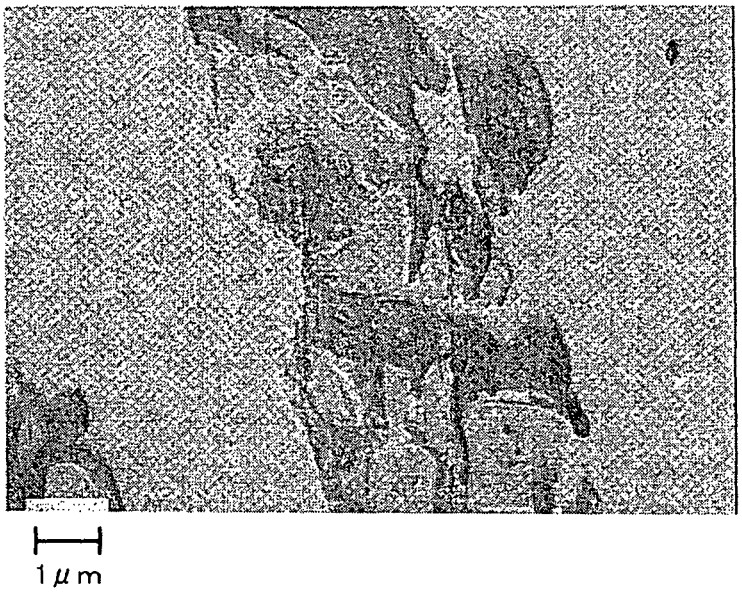
FIG. 2 shows an example of a reflected electron image of a cross-section of a toner.

FIG. 2 shows an example of a reflected electron image of a cross-section of a toner. In FIG. 2, white portions are regions stained by ruthenium tetroxide. Regions stained by ruthenium tetroxide appear white because electrons can less easily pass through such regions.

It can be seen from FIG. 2 that the content of the non-crystalline resin in the toner is large.

As obvious from the above, the toner contains the non-crystalline resin in a large amount, and at the same time, contains the crystalline resin in a large amount in a region near the surface thereof. This makes it possible to improve the low-temperature fixability without causing toner scattering or background smear due to decreasing of the amount of electrostatic charge of the toner.

When kneading a composition containing a crystalline resin and a non-crystalline resin, it is possible to change the abundance ratio between the crystalline resin and the non-crystalline resin in a region near the surface of the toner by controlling the number of rotations of a kneading roller. Specifically, it is possible to increase the content of the crystalline resin in a region near the surface of the toner by increasing the number of rotations of the roller. Further, a larger weight-average molecular weight of the crystalline resin promotes greater phase separation between the crystalline resin and the non-crystalline resin, which would result in a greater content of the crystalline resin in a region near the surface of the toner.

The method for increasing the weight-average molecular weight of the crystalline resin is not particularly limited, but may be to introduce a urethane bond.

It is preferable that the ratio of a detected intensity of secondary ions derived from the crystalline resin to a detected intensity of secondary ions derived from the non-crystalline resin be 0.10 or less, where the intensities are measured by time-of-flight secondary ion mass spectroscopy (TOF-SIMS). If the ratio of the detected intensity of secondary ions derived from the crystalline resin to the detected intensity of secondary ions derived from the non-crystalline resin is greater than 0.10, toner scattering and background smear might occur.

TOF-SIMS can analyze a region near the surface of the toner that reaches a depth of 1 nm to 2 nm from the surface, which is a region by far nearer the surface of the toner than can be analyzed by a scanning electron microscope.

In order to calculate detected intensity of secondary ions derived from the crystalline-resin and non-crystalline resin by TOF-SIMS, it is necessary to identify the building blocks of the crystalline resin and non-crystalline resin contained in the toner. It is possible to analyze the building blocks of the crystalline-resin and non-crystalline resin contained in the toner by GC-MS and NMR. Further, it is possible to calculate a ratio between the crystalline resin and the non-crystalline resin by measuring crystallinity from X-ray diffraction spectra. In this case, it is possible to determine the building blocks of the crystalline resin and non-crystalline resin contained in the toner based on whether they match the ratio between the crystalline resin and the non-crystalline resin.

There is an inclination that a detected intensity of secondary ions derived from the crystalline resin is smaller, as the weight-average molecular weight of the crystalline resin is greater.

At the melting point, a crystalline resin brings about crystalline transformation to have a melt viscosity that has steeply lowered from the viscosity in the solid state, to thereby express a fixing property to a recording medium.

On the other hand, a non-crystalline resin has its melt viscosity gradually lower as the temperature rises from the glass transition point, and has a difference of several ten degrees centigrade between the glass transition point and a temperature at which its melt viscosity has lowered enough to express a fixing property, the latter temperature being a softening temperature, for example.

Therefore, in order to improve the low-temperature fixability of a toner containing a non-crystalline resin but not a crystalline resin, it is necessary to lower the softening point of the non-crystalline resin by lowering the glass transition point or molecular weight of the non-crystalline resin, which would however result in insufficient heat resistance storage stability and hot offset resistance.

Hence, a non-crystalline resin may be combined with a crystalline resin, which makes it possible to improve the low-temperature fixability without lowering the heat resistance storage stability and hot offset resistance.

The toner described above, which contains the crystalline resin and the non-crystalline resin phase-separately, has excellent low-temperature fixability and can prevent occurrence of toner scattering and background smear. Specifically, in the toner described above, which contains the crystalline resin and the non-crystalline resin phase-separately, the crystalline resin and the non-crystalline resin express their own specific characteristics. The non-crystalline resin prevents occurrence of toner scattering and background smear, whereas the crystalline resin improves the low-temperature fixability.

It is possible to confirm that the toner contains the crystalline resin and the non-crystalline resin phase-separately, by the method described below.

(1) DSC Endothermic Peaks of Toner Upon First Temperature Elevation

In a DSC measurement of endothermic peaks of the toner upon the first temperature elevation, endothermic peaks were detected that were attributable to the non-crystalline resin and the crystalline resin respectively. The endothermic peak attributable to the non-crystalline resin had a peak top at 40° C. to 70° C. The endothermic peak attributable to the crystalline resin had a peak top at 60° C. to 80° C.

(2) X-Ray Diffraction Spectrum of Toner

In a measurement of an X-ray diffraction spectrum of the toner, a diffraction peak attributable to the crystalline resin was detected at $2\theta=20°$ to 25°

The volume resistivity of the toner is typically from $10^{10.7}$ Ω·cm to $10^{11.2}$ Ω·cm, preferably from $10^{10.9}$ Ω·cm to $10^{11.15}$ Ω·cm. If the volume resistivity of the toner is less than $10^{10.7}$ Ω·cm, toner scattering and background smear might occur. If the volume resistivity of the toner is greater than $10^{11.2}$ Ω·cm, image density might degrade.

The volume resistivity of a toner is a volume resistivity of a pellet obtained by pressing the toner.

The smaller the content of the crystalline resin in the toner, or the greater the kneading shear, the larger the volume resistivity of the toner.

The toner described above typically has a sea-island structure including seas containing the crystalline resin and islands containing the non-crystalline resin.

It is possible to confirm the sea-island structure by observing a cross-section of the toner. At this time, it is possible to give contrast by staining the non-crystalline resin with ruthenium tetroxide.

<Crystalline Resin>

Examples of the crystalline resin include but are not limited to crystalline polyester, crystalline polyurethane, crystalline polyurea, crystalline polyamide, crystalline polyether, a crystalline vinyl resin, crystalline urethane-modified polyester, and crystalline urea-modified polyester. Two ore more of them may be used in combination. Among them, preferred are crystalline resins having a urethane bond, a urea bond, or both thereof in the main chain. A crystalline resin having a urethane bond, a urea bond, or both thereof in the main chain forms a sea-island structure because it is not compatibly dissolvable with a non-crystalline resin. Further, a crystalline resin having an urethane bond, an urea bond, or both thereof in the main chain has an increased hardness, because of having the urethane bond, the urea bond, or both thereof. This makes it more likely for the toner to be pulverized at non-crystalline resin portions that are present between crystalline resin portions, to thereby have the surface covered with the non-crystalline resin though it contains the crystalline resin in the region near the surface.

Examples of crystalline resins having a urethane bond, a urea bond, or both thereof in the main chain include crystalline polyurethane, crystalline polyurea, crystalline urethane-modified polyester, and crystalline urea-modified polyester.

It is possible to synthesize the crystalline urethane-modified polyester by introducing an isocyanate group to the terminal of crystalline polyester and then reacting the crystalline polyester with a polyol.

It is possible to synthesize the crystalline urea-modified polyester by introducing an isocyanate group to the terminal of crystalline polyester and then reacting the crystalline polyester with a polyamine.

It is possible to synthesize the crystalline polyester by polycondensing a polyol and a polycarboxylic acid, by ring-opening-polymerizing lactone, by polycondensing a hydroxycarboxylic acid, or by ring-opening-polymerizing C4 to C12 cyclic ester, which corresponds to a dehydrated condensation product of two or three molecules of hydroxycarboxylic acid. Among them, a polycondensation of a diol and a carboxylic acid is preferable.

The polyol may be used alone, or may be used in combination with a trihydric or higher alcohol.

Examples of the diol include but are not limited to: an aliphatic diol such as straight-chain aliphatic diol and branched aliphatic diol; alkylene ether glycol having 4 to 36 carbon atoms; an alicyclic diol having 4 to 36 carbon atoms; an alkylene oxide adduct (with the number of moles added being 1 to 30) of an alicyclic diol such as an ethylene oxide adduct, a propylene oxide adduct, and a buthylene oxide adduct thereof; an alkylene oxide adduct (with the number of moles added being 2 to 30) of bisphenols such as an ethylene oxide adduct, a propylene oxide adduct, and a buthylene oxide adduct thereof; a polylactone diol; a polybutadiene diol; a diol having a carboxyl group, a diol having a sulfonic acid group or a sulfamic acid group, and a diol having other functional groups such as a salt of these groups. Two or more of them may be used in combination. Among these, the aliphatic diol having 2 to 36 carbon atoms in the main chain is preferable, and a straight-chain aliphatic diol having 2 to 36 carbon atoms in the main chain is more preferable.

A content of the straight-chain aliphatic diol in the diol is typically 80 mol % or greater, preferably 90 mol % or greater. If the content of the straight-chain aliphatic diol in the diol is less than 80 mol %, it might be difficult to achieve both low-temperature fixability and heat resistance storage stability in the toner.

Examples of the straight-chain aliphatic diol having 2 to 36 carbon atoms in the main chain include ethylene glycol, 1,3-propanediol, 1,4-butanediol, 1,5-pentanediol, 1,6-hexanediol, 1,7-heptanediol, 1,8-octanediol, 1-9-nonanediol, 1,10-decanediol, 1,11-undecanediol, 1,12-dodecanediol, 1,13-tridecanediol, 1,14-tetradecanediol, 1,18-octadecanediol and 1,20-eicosanediol. Among these, ethylene glycol, 1,3-propanediol, 1,4-butanediol, 1,6-hexanediol, 1,9-nonanediol and 1,10-decanediol are preferable.

Examples of the branched aliphatic diol having 2 to 36 carbon atoms in the main chain include 1,2-propyleneglycol, butanediol, hexanediol, octanediol, decanediol, dodecanediol, tetradecanediol, neopentyl glycol and 2,2-diethyl-1,3-propanediol.

Examples of the alkylene ether glycol having 4 to 36 carbon atoms include diethylene glycol, triethylene glycol, dipropylene glycol, polyethylene glycol, polypropylene glycol and polytetramethylene ether glycol.

Examples of the alicyclic diol having 4 to 36 carbon atoms include 1,4-cyclohexanedimethanol and hydrogenated bisphenol A.

Examples of the bisphenols include bisphenol A, bisphenol F, and bisphenol S.

Examples of the polylactone diol include poly(ε-caprolactone diol).

Examples of the diol having a carboxyl group include a dialkylol alkanoic acid having 6 to 24 carbon atoms such as 2,2-dimethylol propionic acid, 2,2-dimethylol butanoic acid, 2,2-dimethylol heptanoic acid and 2,2-dimethylol octanoic acid.

Examples of the diol having a sulfonic acid group or a sulfamic acid group include: N,N-bis(2-hydroxyethyl)sulfamic acid, and N,N-bis(2-hydroxyalkyl)sulfamic acid (the alkyl group having 1 to 6 carbon atoms) and an alkylene oxide adduct thereof such as an ethylene oxide adduct, a propylene oxide adduct, and a butylene oxide adduct thereof (with the number of moles added being 1 to 6), such as 2-mole propylene oxide adduct of N,N-bis(2-hydroxyethyl) sulfamic acid; and bis(2-hydroxyethyl)phosphate.

Examples of a base used for neutralizing salts of the diol having the carboxyl group and the diol having the sulfonic acid group or the sulfamic acid group include a tertiary amine having 3 to 30 carbon atoms (e.g. triethylamine) and alkali metal hydroxide (e.g. sodium hydroxide).

Among these diols, an alkylene glycol having 2 to 12 carbon atoms, a diol having a carboxyl group, and an alkylene oxide adduct of bisphenols are preferable.

Examples of a trihydric or higher polyol include but are not limited to: alkane polyol (e.g. glycerin, trimethylol ethane, trimethylol propane, pentaerythritol, sorbitol, sorbitan and polyglycerin) and an intramolecular or intermolecular dehydration product thereof, a polyhydric aliphatic alcohol having 3 to 36 carbon atoms such as a sugar (e.g. sucrose and methyl glucoside) and a derivative of the sugar; an alkylene oxide adduct (with the number of moles added being 2 to 30) of trisphenols (e.g. trisphenol PA); an alkylene oxide adduct (with the number of moles added being 2 to 30) of a novolak resin (e.g. phenol novolak and cresol novolak); and an acrylic polyol such as copolymer of a hydroxyethyl (meth)acrylate and other vinyl monomer. Among these, a trihydric or higher polyhydric aliphatic alcohol and an alkylene oxide adduct of a novolak resin are favorable, and the alkylene oxide adduct of a novolak resin is more favorable.

As the polycarboxylic acid, a dicarboxylic acid may be used alone, or a dicarboxylic acid and a trivalent or higher carboxylic acid may be used in combination.

Examples of the dicarboxylic acid include but are not limited to: an aliphatic dicarboxylic acid such as straight-chain aliphatic dicarboxylic acid and branched-chain aliphatic dicarboxylic acid; and an aromatic dicarboxylic acid. Among these, a straight-chain aliphatic dicarboxylic acid is preferable.

Examples of the aliphatic dicarboxylic acid include: an alkanedicarboxylic acid having 4 to 36 carbon atoms such as succinic acid, adipic acid, sebacic acid, azelaic acid, dodecanedicarboxylic acid, octadecanedicarboxylic acid and decylsuccinic acid; an alkenedicarboxylic acids having 4 to 36 carbon atoms such as alkenylsuccinic acid such as dodecenylsuccinic acid, pentadecenylsuccinic acid and octadecenylsuccinic acid; an alkene dicarboxylic acid having 4 to 36 carbon atoms such as maleic acid, fumaric acid and citraconic acid; and cycloaliphatic dicarboxylic acids having 6 to 40 carbon atoms such as dimer acid (dimeric linoleic acid).

Examples of the aromatic dicarboxylic acid include an aromatic dicarboxylic acid having 8 to 36 carbon atoms such as phthalic acid, isophthalic acid, terephthalic acid, t-butylisophthalic acid, 2,6-naphthalenedicarboxylic acid and 4,4'-biphenyldicarboxylic acid.

Examples of the trivalent or higher polycarboxylic acid include but are not limited to an aromatic polycarboxylic acid having 9 to 20 carbon atoms such as trimellitic acid and pyromellitic acid.

Instead of the polycarboxylic acid, an anhydride or an alkyl ester having 1 to 4 carbon atoms (e.g. methyl ester, ethyl ester and isopropyl ester) of the polycarboxylic acid may also be used.

Among these dicarboxylic acids, an aliphatic dicarboxylic acid alone is preferable, and each of adipic acid, sebacic acid, dodecanedicarboxylic acid, terephthalic acid, and isophthalic acid alone is more preferable. Here, it is also preferable to use an aliphatic dicarboxylic acid and an aromatic dicarboxylic acid in combination. It is more preferable to use an aliphatic dicarboxylic acid in combination with terephthalic acid, isophthalic acid, and t-butylisophthalic acid.

It is preferable that the content of an aromatic dicarboxylic acid in the polycarboxylic acid be 20 mol % or less.

Examples of lactone include but are not limited to a mono-lactone having 3 to 12 carbon atoms such as β-propiolactone, γ-butyrolactone, δ-valerolactone and ϵ-caprolactone. Among these, ϵ-caprolactone is preferable.

When ring-opening-polymerizing the lactone, it is possible to use a catalyst such as a metal oxide and an organometallic compound, or to use a diol such as ethylene glycol and diethylene glycol as an initiator.

Examples of commercially available products of the lactone ring-opening polymerization product include H1P, H4, H5 and H7 of PLACCEL series manufactured by Daicel Co., Ltd.

Examples of the hydroxycarboxylic acid used for polycondensation include but are not limited to glycolic acid and lactic acid (e.g., L-form, D-form, and racemic form).

Examples of the hydroxycarboxylic acid used for the cyclic ester include but are not limited to glycolide and lactide (e.g. L-form, D-form and racemic form). Among these, L-lactide and D-lactide are preferable.

A catalyst such as a metal oxide and an organometallic compound may be used for ring-opening polymerization of the cyclic ester.

By modifying the hydroxycarboxylic acid and the cyclic ester such that the polycondensate of the former and the ring-opening polymerization product of the latter have a hydroxyl group or a carboxyl group at their terminals, it is possible to synthesize a polyester diol or a polyester dicarboxylic acid.

It is possible to synthesize the crystalline polyurethane by polyadding a polyol and a polyisocyanate. Above all, a polyaddition product of a diol and a diisocyanate is preferable.

As the polyol, a diol may be used alone, or a diol and a trihydric or higher alcohol may be used in combination.

As the polyol, the same polyols as those listed in the description of the crystalline polyester can be used.

As the polyisocyanate, a diisocyanate may be used alone, or a diisocyanate and a trivalent or higher isocyanate may be used in combination.

Examples of the diisocyanate include but are not limited to: aromatic diisocyanates, aliphatic diisocyanates, alicyclic diisocyanates, and aromatic-aliphatic diisocyanates. Specific examples of these diisocyanates include: an aromatic diisocyanate having 6 to 20 carbon atoms except the carbon in the isocyanate group, an aliphatic diisocyanate having 2 to 18 carbon atoms except the carbon in the isocyanate group, an alicyclic diisocyanate having 4 to 15 carbon atoms except the carbon in the isocyanate group, an aromatic aliphatic diisocyanate having 8 to 15 carbon atoms except the carbon in the isocyanate group; a modified product of these diisocyanates having e.g. a urethane group, a carbodiimide group, an allophanate group, a urea group, a biuret group, a uretdione group, a uretoimin group, an isocyanurate group or an oxazolidone group); and a mixture of two or more types thereof.

Examples of the aromatic diisocyanates include 1,3-phenylene diisocyanate, 1,4-phenylene diisocyanate, 2,4-tolylene diisocyanate, 2,6-tolylene diisocyanate, crude tolylene diisocyanate, 2,4'-diphenylmethane diisocyanate, 4,4'-diphenylmethane diisocyanate, crude diphenylmethane diisocyanate [a phosgene compound of crude bis(aminophenyl)methane (condensation product of formaldehyde and aromatic amine (aniline) or a mixture thereof, and a phosgene compound of a mixture of bis(aminophenyl)methane and a small amount (e.g., 5% by mass to 20% by mass) of an amine having three or more functional groups], 1,5-naphthylene diisocyanate, 4,4',4"-triphenylmethane triisocyanate, m-isocyanatophenyl sulfonyl isocyanate, and p-isocyanatophenyl sulfonyl isocyanate.

Examples of the aliphatic diisocyanates include ethylene diisocyanate, tetramethylene diisocyanate, hexamethylene diisocyanate, dodecamethylene diisocyanate, 1,6,11-undecane triisocyanate, 2,2,4-trimethylhexamethylene diisocyanate, lysine diisocyanate, 2,6-diisocyanatomethyl caproate, bis(2-isocyanatoethyl)fumarate, bis(2-isocyanatoethyl)carbonate, and 2-isocyanatoethyl-2,6-diisocyanato hexanoate.

Examples of the alicyclic diisocyanates include isophorone diisocyanate, dicyclohexylmethane-4,4'-diisocyanate, cyclohexylene diisocyanate, methyl cyclohexylene diisocyanate, bis(2-isocyanatoethyl)-4-cyclohexene-1,2-dicarboxylate, 2,5-norbornane diisocyanate, and 2,6-norbornane diisocyanate.

Examples of the aromatic-aliphatic diisocyanates include m-xylylene diisocyanate, p-xylylene diisocyanate, and α,α,α',α'-tetramethylxylylene diisocyanate.

Examples of the modified product of a diisocyanate include modified products of a diisocyanate including: modified diphenylmethane diisocyanates such as a urethane-modified diphenylmethane diisocyanate, a carbodiimide-modified diphenylmethane diisocyanate, and trihydrocarbyl phosphate-modified diphenylmethane diisocyanate; and an urethane-modified tolylene diisocyanate such as a prepolymer including an isocyanate group.

Among these diisocyanates, an aromatic diisocyanate having 6 to carbon atoms except the carbon in the isocyanate group, an aliphatic diisocyanate having 4 to 12 carbon atoms except the carbon in the isocyanate group, and an alicyclic diisocyanate having 4 to 15 carbon atoms except the carbon in the isocyanate group are preferable. More preferable are tolylene diisocyanate, diphenylmethane diisocyanate, hexamethylene diisocyanate, hydrogenated diphenylmethane diisocyanate, and isophorone diisocyanate.

It is possible to synthesize the crystalline polyurea by polyadding a polyamine and a polyisocyanate. Above all, a polyaddition product of a diamine and a diisocyanate is preferable.

As the polyisocyanate, a diisocyanate may be used alone, or a diisocyanate and a trivalent or higher isocyanate may be used in combination.

As the polyisocyanate, the same polyisocyanates as those listed in the description of the crystalline polyurethane can be used.

As the polyamine, a diamine may be used alone, or a diamine and a trivalent or higher amine may be used in combination.

Examples of the polyamine include but are not limited to aliphatic polyamines and aromatic polyamines. Among these, an aliphatic polyamine having 2 to 18 carbon atoms and an aromatic polyamine having 6 to 20 carbon atoms are preferable.

Examples of the aliphatic polyamines having 2 to 18 carbon atoms include: an alkylenediamine having 2 to 6 carbon atoms such as ethylenediamine, propylenediamine, trimethylenediamine, tetramethylenediamine and hexamethylenediamine; a polyalkylenepolyamine having 4 to 18 carbon atoms such as diethylenetriamine, iminobis(propylamine), bis(hexamethylene)triamine, triethylenetetramine, tetraethylenepentamine and pentaethylenehexamine; a substituent of alkyelenediamine or polyalkylenediamine by an alkyl group having 1 to 4 carbon atoms or a hydroxyalkyl group having 2 to 4 carbon atoms such as dialkylaminopropylamine, trimethylhexamethylenediamine, aminoethylethanolamine, 2,5-dimethyl-2,5-hexamethylenediamine and methyliminobis(propylamine); an alicyclic diamine having 4 to 15 carbon atoms such as 1,3-diaminocyclohexane, isophorone diamine, mentheneediamine and 4,4'-methylenedicyclohexanediamine (hydrogenated methylenedianiline); a heterocyclic diamine having 4 to 15 carbon atoms such as piperazine, N-aminoethylpiperazine, 1,4-diaminoethylpiperazine, 1,4-bis(2-amino-2-methylpropyl)piperazine, 3,9-bis(3-aminopropyl)-2,4,8,10-tetraoxaspiro[5,5]undecane; and aliphatic diamines including an aromatic ring having 8 to 15 carbon atoms such as xylylenediamine and tetrachloro-p-xylylenediamine.

Examples of aromatic diamines having 6 to 20 carbon atoms include: non-substituted aromatic diamines such as 1,2-phenylenediamine, 1,3-phenylenediamine, 1,4-phenylenediamine, 2,4'-diphenylmethanediamine, 4,4'-diphenylmethanediamine, crude diphenylmethanediamine (polyphenylpolymethylenepolyamine), diaminodiphenyl sulfone, benzidine, thiodianiline, bis(3,4-di-aminophenyl)sulfone, 2,6-diaminopyridine, m-aminobenzylamine, triphenylmethane-4,4',4"-triamine and naphthylenediamine; aromatic diamines having a nuclear-substituted alkyl group having 1 to 4 carbon atoms such as 2,4-tolylenediamine, 2,6-tolylenediamine, crude tolylenediamine, diethyltolylenediamine, 4,4'-diamino-3,3'-dimethyldiphenylmethane, 4,4'-bis(o-toluidine), dianisidine, diaminoditolyl sulfone, 1,3-dimethyl-2,4-diaminobenzene, 1,3-dimethyl-2,6-diaminobenzene, 1,4-diisopropyl-2,5-diaminobenzene, 2,4-diaminomesitylene, 1-methyl-3,5-diethyl-2,4-diaminobenzene, 2,3-dimethyl-1,4-diaminonaphthalene, 2,6-dimethyl-1,5-diaminonaphthalene, 3,3',5,5'-tetramethylbenzidine, 3,3',5,5'-tetramethyl-4,4'-diaminodiphenylmethane, 3,5-diethyl-3'-methyl-2',4-diaminodiphenylmethane, 3,3'-diethyl-2,2'-diaminodiphenylmethane, 4,4'-diamino-3,3'-dimethyldiphenylmethane, 3,3',5,5'-tetraethyl-4,4'-diaminobenzophenone, 3,3',5,5'-tetraethyl-4,4'-diamino diphenyl ether and 3,3',5,5'-tetraisopropyl-4,4'-diaminodiphenyl sulfone; methylenebis(o-chloroaniline), 4-chloro-o-phenylenediamine, 2-chloro-1,4-phenylenediamine, 3-amino-4-chloroaniline, 4-bromo-1,3-phenylenediamine, 2,5-dichloro-1,4-phenylenediamine, 5-nitro-1,3-phenylenediamine and 3-dimethoxy-4-aminoaniline; halo groups such as a chloro group, a bromo group, an iodine group, and a fluoro group such as 4,4'-diamino-3,3'-dimethyl-5,5'-dibromodiphenylmethane, 3,3'-dichlorobenzidine, 3,3'-dimethoxybenzidine, bis(4-amino-3-chlorophenyl)oxide, bis(4-amino-2-chlorophenyl)propane, bis(4-amino-2-chlorophenyl) sulfone, bis(4-amino-3-methoxyphenyl) decane, bis(4-aminophenyl)sulfide, bis(4-aminophenyl) telluride, bis(4-aminophenyl)selenide, bis(4-amino-3-methoxyphenyl)disulfide, 4,4'-methylenebis(2-iodoaniline), 4,4'-methylenebis(2-bromoaniline), 4,4'-methylenebis(2-fluoroaniline) and 4-aminophenyl-2-chloroaniline; alkoxy groups such as a methoxy group and an ethoxy group; aromatic diamines having a nuclear substituted electron-withdrawing group such as a nitro group; and aromatic diamines having a secondary amino group such as 4,4'-bis(methylamino)diphenylmethane and 1-methyl-2-methylamino-4-aminobenzene [a part or all the primary amino group of the non-substituted aromatic diamine, the aromatic diamine having a nuclear-substituted alkyl group having 1 to 4 carbon atoms, and the aromatic diamine having a nuclear-substituted electron-withdrawing group is replaced with a lower alkyl group such as a methyl group and an ethyl group].

Other examples of the diamine include: polyamide polyamines such as a polyamide polyamine obtained by condensation of a dicarboxylic acid (e.g. a dimer acid) with an excess amount of the polyamine (e.g. alkylenediamine and polyalkylenepolyamine) (the excess amount being 2 mol or greater per 1 mol of the dicarboxylic acid); and a polyether polyamine such as hydrate of cyanoethylated polyether polyol (e.g. polyalkylene glycol).

Instead of the polyamine, it is also possible to use, for example, oxazolidine, or ketimine which is obtained by blocking an amino group of the polyamine with a ketone such as acetone, methylethylketone, and methylisobutylketone.

It is possible to synthesize the crystalline polyamine by polycondensing a polyamine and a polycarboxylic acid. Above all, a polycondensate of a diamine and a dicarboxylic acid is preferable.

As the polyamine, a diamine may be used alone, or a diamine and a trivalent or higher amine may be used in combination.

As the polyamine, the same polyamines as those listed in the description of the polyurea can be used.

As the polycarboxylic acid, a dicarboxylic acid may be used alone, or a dicarboxylic acid and a trivalent or higher carboxylic acid may be used in combination.

As the polycarboxylic acid, the same polycarboxylic acids as those listed in the description of the polyester can be used.

Examples of the crystalline polyether include but are not limited to a crystalline polyoxyalkylene polyol.

Examples of methods for synthesizing the crystalline polyoxyalkylene polyol include but are not limited to: a method for ring-opening-polymerizing a chiral alkylene oxide in the presence of a catalyst (see Journal of the American Chemical Society, 1956, Vol. 78, No. 18, pp. 4,787-4,792, for example); and a method for ring-opening-polymerizing a racemic alkylene oxide in the presence of a catalyst.

Examples of the method for ring-opening-polymerizing a racemic alkylene oxide in the presence of a catalyst include: a method of using as a catalyst a compound obtained by contacting a lanthanide complex and organic aluminum (see JP-A No. 11-12353, for example); and a method of reacting a bimetal-g-oxo alkoxide and a hydroxyl compound in advance (see JP-A No. 2001-521957, for example)

As a method for synthesizing a polyoxyalkylene polyol having an extremely high isotacticity, for example, a method of using a salen complex as a catalyst (see Journal of the American Chemical Society, 2005, Vol. 127, No. 33, pp. 11,566-11,567, for example) is known. For example, when a diol or water is used as an initiator in a ring-opening polymerization of a chiral alkylene oxide, a polyoxyalkylene glycol having a hydroxyl group at an end thereof and having an isotacticity of 50% or greater is synthesized. This polyoxyalkylene glycol having an isotacticity of 50% or greater may be that an end thereof is modified to have a carboxyl group, for example. Typically, crystallinity is expressed when the isotacticity is 50% or greater.

Examples of the diol include the same diols as those listed in the description of the crystalline polyester.

Examples of the dicarboxylic acid include the same dicarboxylic acids as those listed in the description of the crystalline polyester.

Examples of the alkylene oxide include but are not limited to alkylene oxides having 3 to 9 carbon atoms such as propylene oxide, 1-chlorooxetane, 2-chlorooxetane, 1,2-dichlorooxetane, epichlorohydrin, epibromohydrin, 1,2-butylene oxide, methyl glycidyl ether, 1,2-pentyleneoxide, 2,3-pentyleneoxide, 3-methyl-1,2-butylene oxide, cyclohexeneoxide, 1,2-hexylene oxide, 3-methyl-1,2-pentyleneoxide, 2,3-hexylene oxide, 4-methyl-2,3-pentyleneoxide, aryl glycidyl ether, 1,2-heptylene oxide, styrene oxide, phenyl glycidyl ether, and combinations of two or more of them. Among these, propylene oxide, 1,2-BO, styrene oxide and cyclohexane oxide are preferable, and PO, 1,2-butylene oxide, and cyclohexane oxide are preferable.

Thy crystalline polyoxyalkylene polyol has an isotacticity of typically 70% or greater, preferably 80% or greater, more preferably 90% or greater, particularly preferably 95% or greater.

It is possible to calculate isotacticity by a method described in Macromolecules, vol. 35, No. 6, pp. 2,389-2,392 (2002).

It is possible to synthesize the crystalline vinyl resin by polyadding a crystalline vinyl monomer, if necessary, together with a non-crystalline vinyl monomer.

Examples of the crystalline vinyl monomer include but are not limited to alkyl (meth)acrylate with a straight-chain alkyl group having 12 to 50 carbon atoms such as lauryl (meth)acrylate, tetradecyl (meth)acrylate, stearyl (meth) acrylate, eicosyl (meth)acrylate, and behenyl (meth)acrylate. Two or more of them may be used in combination.

Examples of the non-crystalline vinyl monomer include but are not limited to vinyl monomers having a molecular weight of 1,000 or less such as: styrenes, (meth)acrylic acid ester, vinyl monomers including a carboxyl group, vinyl ester, and aliphatic hydrocarbon vinyl monomers. Two or more of them may be used in combination.

Examples of the styrenes include styrene, and alkyl styrenes with an alkyl group having 1 to 3 carbon atoms.

Examples of the (meth)acrylic acid ester include: alkyl (meth)acrylates with a straight-chain alkyl group having 1 to 11 carbon atoms such as methyl (meth)acrylate, ethyl (meth) acrylate, and butyl (meth)acrylate; alkyl(meth)acrylates with a branched alkyl group having 12 to 18 carbon atoms such as 2-ethylhexyl (meth)acrylate; hydroxyalkyl (meth) acrylate with a hydroxylalkyl group having 1 to 11 carbon atoms such as hydroxyl ethyl (meth)acrylate; and dialkylaminoalkyl (meth)acrylate with a dialkylaminoalkyl group having 1 to 11 carbon atoms such as dimethylaminoethyl (meth)acrylate and diethyl aminoethyl (meth)acrylate Examples of the vinyl monomers including a carboxyl group include: monocarboxylic acids having 3 to 15 carbon atoms such as (meth)acrylic acid, crotonic acid, and cinnamic acid; dicarboxylic acids having 4 to 15 carbon atoms such as maleic acid, maleic anhydride, fumaric acid, itaconic acid, and citraconic acid; and dicarboxylic acid monoalkyl esters including an alkyl group having 1 to 18 carbon atoms such as maleic acid monoalkyl ester, fumaric acid monoalkyl ester, itaconic acid monoalkyl ester, and citraconic acid monoalkyl ester.

Examples of the vinyl ester include: aliphatic vinyl esters having 4 to 15 carbon atoms such as vinyl acetate, vinyl propionate, and isopropenyl acetate; polyhydric alcohol ester of an unsaturated carboxylic acid having 8 to 50 carbon atoms such as ethylene glycol di(meth)acrylate, propylene glycol di(meth)acrylate, neopentyl glycol di(meth)acrylate, trimethylolpropane tri(meth)acrylate, 1,6-hexanediol diacrylate, and polyethylene glycol di(meth)acrylate; and vinyl esters of an aromatic carboxylic acid having 9 to 15 carbon atoms such as methyl-4-vinyl benzoate.

Examples of the aliphatic hydrocarbon vinyl monomers include olefins having-2 to 10 carbon atoms such as ethylene, propylene, butene and octene; and dienes having 4 to 10 carbon atoms such as butadiene, isoprene and 1,6-hexadiene.

The ratio of the melting point of the crystalline resin to the softening temperature thereof is typically from 0.80 to 1.55, preferably from 0.85 to 1.25, more preferably from 0.90 to 1.20, particularly preferably from 0.90 to 1.19. If the ratio of the melting point of the crystalline resin to the softening temperature thereof is 0.80 or less, the hot offset resistance of the toner might degrade. If it is greater than 1.55, the low-temperature fixability and heat-resistance storage stability of the toner might degrade.

The melting point of the crystalline resin is typically from 60° C. to 80° C., preferably from 65° C. to 70° C. If the melting point of the crystalline resin is lower than 60° C., the heat resistance storage stability of the toner might degrade. If it is higher than 80° C., the low-temperature fixability of the toner might degrade.

The softening temperature of the crystalline resin is typically from 80° C. to 130° C., preferably from 80° C. to 100° C. If the softening temperature of the crystalline resin is lower than 80° C. the heat resistance storage stability of the toner might degrade. If it is higher than 130° C., the low-temperature fixability of the toner might degrade.

It is possible to measure the melting point by differential scanning calorimeters TA-60WS and DSC-60 (manufactured by Shimadzu Corporation. It is possible to measure the softening temperature by a Kouka-shiki flow tester CFT-500D (manufactured by Shimadzu Corporation).

To synthesize a crystalline resin having a melting point of from 60° C. to 80° C. and a softening temperature of from 80° C. to 130° C., it is typical to use only an aliphatic compound, and no aromatic compound.

At a temperature higher than the melting point by 20° C., the crystalline resin has a storage elastic modulus G' of typically $5.0\times10^6$ Pa or less, preferably from $1.0\times10^1$ Pa to $5.0\times10^5$ Pa, more preferably from $1.0\times10^1$ Pa to $1.0\times10^4$ Pa.

At the temperature higher than the melting point by 20° C., the crystalline resin has a loss elastic modulus G" of typically $5.0\times1.0^6$ Pa or less, preferably from $1.0\times10^1$ Pa to $5.0\times10^5$ Pa, more preferably from $1.0\times10^1$ Pa to $1.0\times10^4$ Pa.

It is possible to measure the storage elastic modulus G' and the loss elastic modulus G" by a dynamic viscoelasticity measuring instrument ARES (manufactured by TA instruments) at a frequency of 1 Hz.

The weight-average molecular weight of the crystalline resin is typically from 100,000 to 200,000, preferably from 120,000 to 160,000. If the weight-average molecular weight of the crystalline resin is less than 100,000, the crystalline resin will have increased compatible dissolvability with the non-crystalline resin at high temperatures, which might degrade the heat resistance storage stability of the toner. If the weight-average molecular weight thereof is greater than 200,000, the crystalline resin will be present in the toner by occupying large domains, which might reduce pulverization easiness or degrade the heat resistance storage stability and charging properties.

The toner can be prevented from degradation of the low-temperature fixabililty by containing the crystalline resin with a greater molecular weight and the non-crystalline resin with a smaller molecular weight in combination.

The weight-average molecular weight of the crystalline resin is a polystyrene equivalent molecular weight measured by gel permeation chromatography.

<Non-Crystalline Resin>

Examples of the non-crystalline resin are not particularly limited as long as they can be phase-separated from the crystalline resin, and include: a non-crystalline polyester, a non-crystalline polyurethane, a non-crystalline polyurea, a non-crystalline polyamide, a non-crystalline polyether, a non-crystalline vinyl resin, a non-crystalline urethane-modified polyester, a non-crystalline urea-modified polyester, and combinations of two or more of them. Among them, the non-crystalline polyester is preferable The non-crystalline polyester typically contains a building block derived from an aromatic compound.

Examples of the aromatic compound include but are not limited to an alkylene oxide adduct of bisphenol A, an isophthalic acid, a terephthalic acid, and derivatives thereof.

The content of the building block derived from the aromatic compound in the non-crystalline resin is typically 50% by mass or greater. If the content of the building block derived from the aromatic compound in the non-crystalline resin is less than 50% by mass, the negative chargeability of the toner might degrade.

The glass transition point of the non-crystalline resin is typically from 45° C. to 75° C., preferably from 50° C. to 70° C. If the glass transition point of the non-crystalline resin is lower than 45° C., the heat resistance storage stability of the toner might degrade. If it is higher than 75° C., the low-temperature fixability of the toner might degrade.

The softening temperature of the non-crystalline resin is typically from 90° C. to 150° C., preferably from 90° C. to 130° C. If the softening temperature of the non-crystalline resin is lower than 90° C., the heat resistance storage stability of the toner might degrade. If it is higher than 150° C., the low-temperature fixability of the toner might degrade.

The weight-average molecular weight of the non-crystalline resin is typically from 1,000 to 100,000, preferably from 2,000 to 50,000, more preferably from 3,000 to 10,000. If the weight-average molecular weight of the non-crystalline resin is less than 1,000, the heat resistance storage stability of the toner might degrade. If it is greater than 100,000, the low-temperature fixability of the toner might degrade.

The weight-average molecular weight of the non-crystalline resin is a polystyrene equivalent molecular weight measured by gel permeation chromatography.

<Other Components>

The toner may further contain a releasing agent, a colorant, a charge controlling agent, a flow improver, etc.

Examples of the releasing agent include but are not limited to solid silicone wax, higher fatty acid higher alcohol, montan ester wax, polyethylene wax, polypropylene wax, and combinations of two or more of them. Specific examples of them for being finely dispersed in the toner include carnauba wax free from free fatty acid, montan wax, oxidized rice wax, and combinations of two or more of them.

Carnauba wax is a microcrystal and has an acid value of preferably, 5 mgKOH/g or less.

The montan wax typically means a montan wax purified from minerals, is a microcrystal, and has an acid value of preferably, from 5 mgKOH/g to 14 mgKOH/g.

The oxidized rice wax is an air-oxidized rice bran wax, and has an acid value of preferably, from 10 mgKOH/g to 30 mgKOH/g.

The glass transition point of the releasing agent is typically from 70° C. to 90° C. If the glass transition point of the releasing agent is lower than 70° C., the heat resistance storage stability of the toner might degrade. If it is higher than 90° C., the cold offset resistance might degrade or a sheet might wrap around and adhere to the fixing device.

The mass ratio of the releasing agent to a binder resin is typically from 0.01 to 0.20, preferably from 0.03 to 0.10. If the mass ratio of the releasing agent to the binder resin is less than 0.01, the hot offset resistance of the toner might degrade. If it is greater than 0.20, the transfer property and durability of the toner might degrade.

Without any limitations, the colorant may be any pigment or dye, and examples thereof include: yellow pigments such as cadmium yellow, mineral fast yellow, nickel titanium yellow, naples yellow, naphthol yellow S, Hansa yellow G, Hansa yellow 10G, benzidine yellow GR, quinoline yellow lake, permanent yellow NCG, and tartrazinelake; orange pigments such as molybdenum orange, permanent orange GTR, pyrazolone orange, Vulcan orange, indanthrene brilliant orange RK, benzidine orange G, and indanthrene brilliant orange GK; red pigments such as iron red, cadmium red, permanent red 4R, lithol red, pyrazolone red, watching red calcium salt, lake red D, brilliant carmine 6B, eosin lake, rhodamine lake B, alizarin lake, and brilliant carmine 3B; violet pigments such as fast violet B, and methyl violet lake; blue pigments such as cobalt blue, alkali blue, Victoria blue lake, phthalocyanine blue, metal-free phthalocyanine blue, partial chloride of phthalocyanine blue, fast sky blue, and indanthrene blue BC; green pigments such as chrome green, chromium oxide, pigment green B, and malachite green lake; black pigments such as carbon black, oil furnace black, channel black, lamp black, acetylene black, azine dye such as aniline black, metal salt azo dye, metal oxide, and composite metal oxide; and combinations of two or more of them.

Examples of the charge controlling agent include but are not limited to: nigrosine and an azine dye including an alkyl group having 2 to 16 carbon atoms (Japanese Patent Application Publication (JP-B) No. 42-1627); basic dyes such as C.I.Basic Yello 2 (C.I.41000), C.I.Basic Yello 3, C.I.Basic Red 1 (C.I.45160), C.I.Basic Red 9 (C.I.42500), C.I.Basic Violet 1 (C.I.42535), C.I.Basic Violet 3 (C.I.42555), C.I.Basic Violet 10 (C.I.45170), C.I.Basic Violet 14 (C.I.42510), C.I.Basic Blue 1 (C.I.42025), C.I.Basic Blue3 (C.I.51005), C.I.Basic Blue 5 (C.I.42140), C.I.Basic Blue 7 (C.I.42595), C.I.Basic Blue 9 (C.I.52015), C.I.Basic Blue 24 (C.I.52030), C.I.Basic Blue 25 (C.I.52025), C.I.Basic Blue 26 (C.I.44045), C.I.Basic Green 1 (C.I.42040), C.I.Basic Green 4 (C.I.42000) and lake pigments thereof; quaternary ammonium salts such as C.I.Solvent Black 8 (C.I.26150), benzoylmethyl hexadecyl ammonium chloride and decyltrimethyl chloride; dialkyl tin such as dibutyl tin and dioctyl tin; polyamine resins such as a dialkyltin borate compound, a guanidine derivative, a vinyl polymer including an amino group, and a condensed polymer including an amino group; metal complex salts of mono azo dyes disclosed in JP-B Nos. 41-20153, 43-27596, 44-6397, and 45-26478; salicylates disclosed in JP-B Nos. 55-42752 and 59-7385; Zn, Al, Co, Cr, and Fe metal complexes with dialkyl salicylate, naphthoic acid, and dicarboxylic acid; a sulfonated copper phthalocyanine pigment, an organic boron salt, a quaternary ammonium salt containing fluorine, and a calixarene compound; and combinations of two or more of them.

Examples of the materials to make the flow improver include but are not limited to silica, alumina, titanium oxide, barium titanate, magnesium titanate, calcium titanate, strontium titanate, zinc oxide, silica sand, montmorillonite, clay, mica, wallastonite, diatomaceous earth, chromium oxide, cerium oxide, iron red, antimony trioxide, magnesium oxide, zirconium oxide, barium sulfate, barium carbonate, calcium carbonate, silicon carbide, silicon nitride, and combinations of two or more of them. Among these, silica, alumina, and titanium oxide are preferable.

It is preferable that the flow improver contain the silicon element forming a silicon compound such as silica, and if necessary, a metal element (a doped compound).

Examples of the metal element include but are not limited to Mg, Ca, Ba, Al, Ti, V, Sr, Zr, Zn, Ga, Ge, Cr. Mg, Fe, Co, Ni, and Cu.

The flow improver may be surface-treated with a hydrophobizing agent.

Examples of the hydrophobizing agent include but are not limited to a silane coupling agent, a silylation agent, a silane coupling agent containing an alkyl fluoride group, an organic titanate coupling agent, an aluminum coupling agent, and a silicone oil.

The content of the flow improver in the toner is typically from 0.1% by mass to 5% by mass.

The average primary particle size of the flow improver is typically from 5 nm to 1,000 nm, preferably from 5 nm to 500 nm.

The average primary particle size of the flow improver is an average value of the longer diameters of 100 or more particles measured by a transmission electron microscope.

The weight-average particle size (D4) of the toner is typically from 3 μm to 8 μm, preferably from 4 μm to 7 μm.

The ratio of the weight-average particle size (D4) of the toner to a number-average particle size (D1) thereof is typically from 1.00 to 1.40, preferably from 1.05 to 1.30.

It is possible to measure the number-average particle size (D1) and weight-average particle size (D4) of the toner by Coulter counter method.

A method for manufacturing the toner includes, for example, kneading a toner composition containing the crystalline resin and the non-crystalline resin, pulverizing the kneaded toner composition, and classifying the pulverized toner composition.

The kneader used for kneading the toner composition is not particularly limited, and examples include a sealed kneader, a uniaxial or biaxial extruder, and an open roll kneader. Among them, an open roll kneader is preferable in consideration of dispersibility of the releasing agent.

Examples of commercially-available kneaders include KRC KNEADER (manufactured by Kurimoto Ltd.); BUSS CO-KNEADER (manufactured by Buss Inc.); TEM EXTRUDER (manufactured by Toshiba Machine Co., Ltd.); TEX BIAXIAL KNEADER (manufactured by Japan Steel Works, Ltd.); PCM KNEADER (manufactured by Ikegai Corp.); THREE-ROLL MILL, MIXING ROLL MILL, and KNEADER (manufactured by Inoue MFG., Inc.); KNEADEX (manufactured by Mitsui Mining Co., Ltd.); MS PRESSURIZING KNEADER and KNEADER RUDER (manufactured by Moriyama Manufacturing Co., Ltd.); and BANBARY MIXER (manufactured by Kobe Steel Ltd.).

The open roll kneader includes a plurality of feeding ports and discharging ports that are provided along the axial direction of the roll.

The kneading unit of the open roll kneader is opened, and can easily release kneading heat produced from the kneading of the toner composition.

The open roll kneader typically has two or more rolls. It is preferable that it have a heating roll and a cooling roll.

In the open roll kneader, adjacent two rolls are provided in proximity, and the gap between the rolls is typically from 0.01 mm to 5 mm, preferably from 0.05 mm to 2 mm.

The structure, size, materials, etc. of the rolls are not particularly limited, and the rolls may have any of a flat surface, a corrugated surface, and a bossed/recessed surface.

It is possible to adjust the temperature of the rolls based on the temperature of a heat carrier to be passed through the rolls. The internal space of each roll may be divided into two or more sections to pass heat carriers with different temperatures therethrough.

It is preferable that the temperature of the heating roll, particularly its temperature at the feeding port side be higher than both of the softening point of the binder resin and the melting point of the releasing agent. It is higher by preferably 0° C. to 80° C., more preferably by 5° C. to 50° C. than the higher one of the softening point of the binder resin and the melting point of the releasing agent, In the manufacture of the toner containing a plurality of binder resins, the softening point of the binder resin means the sum of the products of the softening point and the mass ratio of the respective binder resins.

It is preferable that the temperature of the cooling roll, particularly its temperature at the feeding port side be lower than the softening point of the binder resin.

The heating roll and the cooling roll have a rotation number, i.e., a circumferential velocity of preferably from 2 m/min to 100 m/min.

The heating roll and the cooling roll preferably have different circumferential velocities, and the ratio of the circumferential velocity of the cooling roll to that of the heating roll is typically from 1/10 to 9/10, preferably from 3/10 to 8/10.

Examples of the pulverizer used for pulverizing the toner composition that has been melted and kneaded include but are not limited to; COUNTER JET MILL, MICRON JET, and INOMIZER (manufactured by Hosokawa Micron Corporation); IDS MILL and PJM JET PULVERIZER (manufactured by Nippon Pneumatic Mfg. Co., Ltd.); CROSS JET MILL (manufactured by Kurimoto Ltd.); ULMAX (manufactured by Nisso Engineering Co., Ltd.); SK-JET-O-MILL (manufactured by Seishin Enterprise Co., Ltd.); CRYPTRON (manufactured by Kawasaki Heavy Industries, Ltd.); TURBO MILL (manufactured by Turbo Kogyo Co., Ltd.); and SUPER ROTOR (manufactured by Nisshin Engineering Inc.).

Examples of the classifier used for classifying the pulverized toner composition include but are not limited to: CLASSIEL, MICRON CLASSIFIER, and SPEDIC CLASSIFIER (manufactured by Seishin Enterprise Co., Ltd.); TURBO CLASSIFIER (manufactured by Nisshin Engineering Inc.); MICRON SEPARATOR, TURBOPLEX (ATP), and TSP SEPARATOR (manufactured by Hosokawa Micron Corporation); ELBOW JET (manufactured by Nittetsu Mining Co., Ltd.); DISPERSION SEPARATOR (manufactured by Nippon Pneumatic Mfg. Co., Ltd.); and YM MICROCUT (manufactured by Yasukawa Shoji Co., Ltd.).

Examples of the sieving device used for sieving coarse particles include but are not limited to: ULTRASONIC (manufactured by Koei Sangyo Co., Ltd.); RESONA SIEVE, and JYRO SIFTER (manufactured by Tokuju Corporation); VIBRASONIC SYSTEM (manufactured by Dulton Co., Ltd.); SONICLEAN (manufactured by Sintokogio Ltd.); TURBO SCREENER (manufactured by Turbo Kogyo Co., Ltd.); MICRO SIFTER (manufactured by Makino Mfg. Co., Ltd.); and a circular vibrating sieve.

Base particles obtained from the classification of the pulverized toner composition may be mixed with different kinds of particles such as those of the charge controlling agent, the flow improver, etc. At this time, a mechanical impact may be applied, if necessary. This enables the different kinds of particles to be fixed on the surface of the base particles.

Examples of the method for applying a mechanical impact include but are not limited to a method of applying an impact to the particles by a blade rotating at a high speed, and a method of adding the particles into a high-speed air flow and accelerating the air flow to make the particles collide on other particles or make composite particles collide on an impact board.

Examples of a device for applying a mechanical impact include but are not limited to ANGMILL (manufactured by Hosokawa Micron Corporation), an apparatus made by modifying I-TYPE MILL (manufactured by Nippon Pneumatic Mfg. Co., Ltd.) to reduce the pulverizing air pressure, a hybridization system (manufactured by Nara Machinery Co., Ltd.), CRYPTRON SYSTEM (manufactured by Kawasaki Heavy Industries, Ltd.) and an automatic mortar.

(Developer)

A developer disclosed contains the toner, and may further contain a carrier.

It is preferable that the core of the carrier be coated with a coating layer.

Examples of materials to make the core include but are not limited to: iron powder having a mass susceptibility of 100 emu/g or greater; a highly magnetically susceptible material such as magnetite having a mass susceptibility of 75 emu/g to 120 emu/g; a poorly magnetically susceptible material such as a copper-zinc (Cu—Zn) material having a mass susceptibility of 30 emu/g to 80 emu/g; a manganese-strontium (Mn—Sr) material and a manganese-magnesium (Mn—Mg) material having a mass susceptibility of 50 emu/g to 90 emu/g; and combinations of two or more of them.

The volume median particle size (D50) of the core is typically from 10 μm to 200 μm, preferably from 40 μm to 100 μm. If the volume median particle size (D50) is smaller than 10 μm, the carrier might scatter. If the volume median particle size (D50) is greater than 200 μm, the toner might scatter.

The coating layer contains a resin.

Examples of the resin include but are not limited to an amino resin, a vinyl resin, polystyrene, a halogenated olefin resin, polyester, polycarbonate, polyethylene, polyvinyl fluoride, polyvinylidene fluoride, polytrifluoroethylene, polyhexafluoropropylene, a copolymer of vinylidene fluoride and an acrylic monomer, a copolymer of vinylidene fluoride and vinyl fluoride, and a fluoroterpolymer such as a terpolymer of tetrafluoroethylene, vinylidene fluoride, and a non-fluoromonomer, a silicone resin, and combinations of two or more of them. Among these, a silicon resin is preferable.

Examples of the silicon resin include: straight silicone resins; and modified silicone resins modified with an alkyd resin, polyester, an epoxy resin, an acrylic resin, and an urethane resin.

Examples of commercially-available products of the straight silicone resins include: KR271, KR255, and KR152 (manufactured by Shin-Etsu Chemical Co., Ltd.); and SR2400, SR2406, and SR2410 (manufactured by Dow Corning Toray Silicone Co., Ltd.).

Examples of commercially-available products of the modified silicone resins: KR206 (modified with alkyd), KR5208 (modified with acrylic), ES1001N (modified with epoxy), and KR305 (modified with urethane) (manufactured by Shin-Etsu Chemical Co., Ltd.); and SR2115 (modified with epoxy) and SR2110 (modified with alkyd) (manufactured by Dow Corning Toray Silicone Co., Ltd.).

The coating layer may further contain conductive particles.

Examples of the conductive particles include but are not limited to metal particles, carbon black, titanium oxide particles, tin oxide particles, and zinc oxide particles. Among these, carbon black is preferable.

The conductive particles have an average particle size of typically 1 μm or smaller. If the average particle size of the conductive particles is greater than 1 μm, it might become difficult to control the electrical resistance of the coating layer.

It is possible to form the coating layer by coating the surface of the core with a coating layer coating liquid containing a resin and an organic solvent, drying the coated surface, and then baking it.

Examples of the organic solvent include but are not limited to toluene, xylene, methylethylketone, methylisobutylketone, cellosolve, and butyl acetate.

Examples of the method for coating with the coating layer coating liquid include but are not limited to immersing, spraying, and brush coating.

The heater used for baking may be an external heater or an internal heater.

Examples of the heater include but are not limited to a fixing-type electric furnace, a flowing-type electric furnace, a rotary electric furnace, a burner furnace, and a microwave heater.

The content of the coating layer in the carrier is typically from 0.01% by mass to 5.0% by mass.

The mass ratio of the toner to the carrier is typically from 1% by mass to 10% by mass.

(Image Forming Apparatus)

An image forming apparatus disclosed include a photoconductor, a charging unit, an exposure unit, a developing unit, a transfer unit, and a fixing unit, and may further include a cleaning unit, a neutralizing unit, and a recycling unit, if necessary.

Examples of the shape of the photoconductor include but are not limited to a drum shape, a sheet shape, and an endless belt shape.

The photoconductor may have a single-layer structure or a multilayer structure.

Examples of the material to make the photoconductor include but are not limited to: inorganic materials such as amorphous silicon, selenium, cadmium sulfide, and zinc oxide; and organic materials such as polysilane and phthalopolymethine.

The charging unit is not particularly limited as long as it can charge the surface of the photoconductor uniformly by applying a voltage. Examples thereof include a contact-type charging unit that charges the photoconductor by contacting it, and a contactless charging unit that charges the photoconductor contactlessly.

Examples of the contact-type charging unit include a conductive or semi-conductive charging roller, a magnetic brush, a fur brush, a film, and a rubber blade.

Examples of the contactless charging unit include: a contactless charger, a needle electrode device, and a solid-state discharging element utilizing corona discharge; and a conductive or semi-conductive charging roller disposed at a slight gap from the photoconductor.

The exposure unit is not particularly limited as long as it can expose the surface of the photoconductor to have the intended image. Examples thereof include exposure units of a copier optical system, a rod lens array system, a laser optical system, a liquid crystal shutter optical system, and an LED optical system.

The exposure unit may be a backlighting type that exposes the photoconductor to have an intended image from the rear side of the photoconductor.

The developing unit is, not particularly limited as long as it can develop an electrostatic latent image formed on the surface of the photoconductor with the developer. Examples thereof include a developing unit that can house a developer and supply the developer to an electrostatic latent image by contacting it or contactlessly.

The developing unit may be a single-color developing unit or a multi-color developing unit.

It is preferable that the developing unit include: a stirrer that electrically charges the developer by frictionally stirring it; and a magnet roller that can rotate by carrying the developer on its surface.

In the developing unit, the developer is mixed and stirred to cause friction to electrically charge the toner, and then the developer is retained on the surface of the rotating magnet roller in a chain-like form, to thereby form a magnetic brush. Since the magnetic roller is disposed in the proximity of the photoconductor, the toner constituting the magnetic brush formed on the surface of the magnetic roller is partially transferred to the surface of the photoconductor by an electrical attractive force. As a result, the electrostatic latent image is developed by the toner to form a toner image on the surface of the photoconductor.

Figure 3:
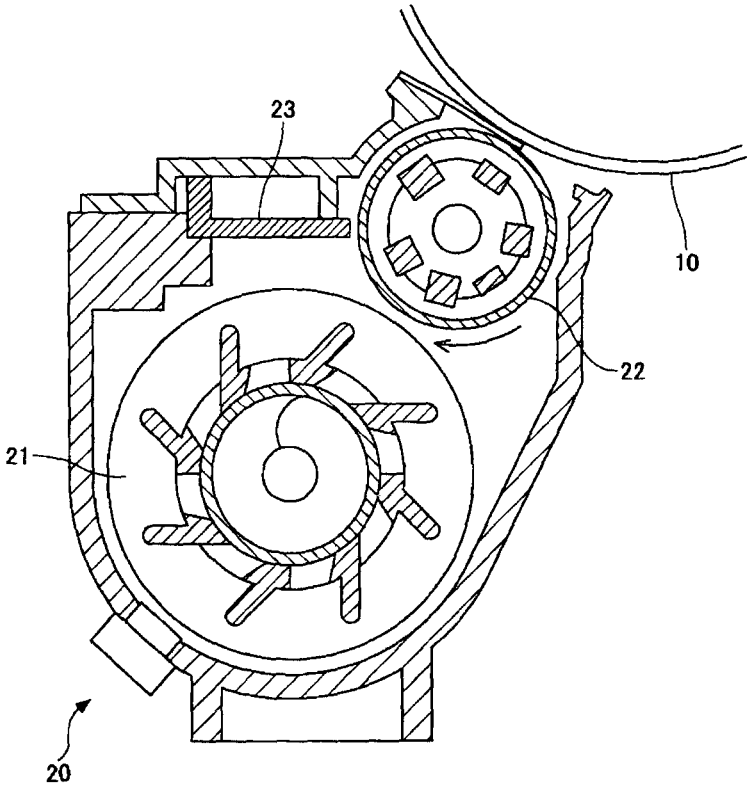
FIG. 3 is a schematic diagram showing an example of a developing device.

FIG. 3 shows an example of a developing device as the developing unit.

In the developing device 20, a developer (not shown) is stirred and delivered by a screw 21 and supplied to a developing sleeve 22. At this time, the developer supplied to the developing sleeve 22 is restricted by a doctor blade 23 to have a fixed layer thickness. That is, the amount of the developer supplied to the developing sleeve 22 is controlled by a doctor gap, which is the gap between the developing sleeve 22 and the doctor blade 23. If the doctor gap is excessively small, the amount of the developer supplied to the developing sleeve 22 is excessively small to degrade the image density. On the other hand, if the doctor gap is excessively large, the amount of the developer supplied to the developing sleeve 22 is excessively large to have the carrier adhere to the drum-shaped photoconductor 10. The developing sleeve 22 internally includes a magnet (not shown) that forms a magnetic field to retain the developer on the circumferential surface of the developing sleeve in a chain-like form. The developer is retained on the developing sleeve 22 in the chain-like form along magnetic lines running in the normal direction formed by the magnet, to thereby form a magnetic brush.

The developing sleeve 22 and the photoconductor 10 are disposed in proximity with a fixed gap (a developing gap) provided therebetween, to have a developing region in the area where they face each other. The developing sleeve 22 is a cylinder made of a non-magnetic material such as aluminum, brass, stainless steel, and a conductive resin, and can be rotated by a rotary driving mechanism (not shown). The magnetic brush is conveyed to the developing region by the rotation of the developing sleeve 22. The developing sleeve 22 receives a developing voltage applied by a developing power source (not shown), has the toner in the magnetic brush separated from the carrier by a developing electric field formed between the developing sleeve 22 and the photoconductor 10, and develops the electrostatic latent image formed on the surface of the photoconductor 10. An AC voltage may be superposed on the developing voltage.

The developing gap is preferably from 5 to 30 times as large as the particle size of the developer. If the developing gap is excessively large, the image density might degrade.

Meanwhile, it is preferable that the doctor gap be as large as the developing gap or be slightly larger than the developing gap.

The ratio of the linear velocity of the developing sleeve 22 to the linear velocity of the photoconductor 10 is preferably 1.1 or greater. If the ratio of the linear velocity of the developing sleeve 22 to the linear velocity of the photoconductor 10 is excessively small, the image density might degrade.

It is possible to control the process conditions by providing a sensor at the position at which the photoconductor 10 is set when the development is completed, to detect the amount of the toner adhered based on optical reflectivity.

Examples of the transfer unit include a transfer unit that directly transfers a toner image formed on the surface of the photoconductor to a recording medium, and a transfer unit that firstly transfers a toner image formed on the surface of the photoconductor to an intermediate transfer member, and then secondly transfers it to a recording medium.

The fixing unit is not particularly limited as long as it can fix the toner image transferred to the recording medium. Examples thereof include a fixing unit that includes a fixing member and a heat source for heating the fixing member.

The fixing member is not particularly limited as long as it includes members that contact each other to form a nipping member. Examples thereof include a combination of an endless belt and a roller and a combination of a roller and another roller.

Types of the fixing unit include an internal heating type that has a roller, a belt, or both thereof, and applies heat from a surface of the recording medium that does not contact the toner image to heat, press, and fix the toner image transferred to the recording medium, and an external heating type that has a roller, a belt, or both thereof, and applies heat from a surface of the recording medium that contacts the toner image to heat, press, and fix the toner image transferred to the recording medium The internal heating type and the external heating type may be combined.

Examples of the fixing unit of the internal heating type include one that has a fixing member in which a heat source is provided.

Examples of the heat source include but are not limited to a heater and a halogen lamp.

Examples of the fixing unit of the external heating type include one that has a fixing member, of which surface is heated by a heater.

Examples of the heater include but are not limited to an electromagnetic induction heater.

Examples of the electromagnetic induction heater include one that includes: an induction coil provided in proximity to the fixing member such as a heating roller; a shielding layer on which the induction coil is provided; and an insulating layer provided on a surface of the shielding layer that is opposite to the surface on which the induction coil is provided.

Examples of the heating roller include but are not limited to one that is made of a magnetic material, and a heat pipe.

It is preferable that the induction coil be disposed on a side of the heating roller that is opposite to a side where the heating roller contacts a fixing member such as a pressing roller and an endless belt, and in a manner that a semi-cylindrical portion of the induction coil is surrounded.

Examples of the recording medium include but are not limited to paper.

Examples of the image forming apparatus include but are not limited to a facsimile and a printer.

(Process Cartridge)

The process cartridge includes a photoconductor and a developing unit, is attachable to and detachable from the image forming apparatus body, and may further include a charging unit, an exposure unit, a transfer unit, a cleaning unit, and a neutralizing unit, if necessary.

Figure 4:
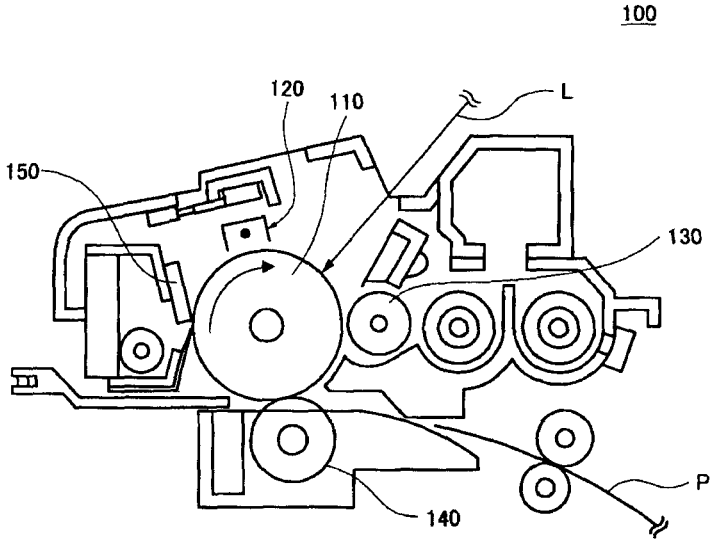
FIG. 4 is a schematic diagram showing an example of a process cartridge.

FIG. 4 shows an example of the process cartridge.

A process cartridge 100 includes a built-in photoconductor 110 having a drum shape, a charging device 120 as the charging unit, a developing device 130 as the developing unit, a transfer device 140 as the transfer unit, and a cleaning device 150 as the cleaning unit.

Next, an image forming process by the process cartridge 100 will be explained. First, the photoconductor 110 rotates in the direction indicated by the arrow, has the surface charged by the charging device 120, and has an electrostatic latent image formed on the surface by exposure light 103 from an exposure device (not shown). Then, the electrostatic latent image formed on the surface of the photoconductor is developed to a toner image by the developing device 130 with the developer. The toner image is transferred by the transfer device 140 to a recording medium 105 and printed. The surface of the photoconductor on which the toner image has been formed is cleaned by the cleaning device 150.

EXAMPLES

The present invention will be specifically explained below based on Examples. The present invention is not limited to the Examples. Parts means parts by mass.

(Synthesis of Crystalline Urethane-Modified Polyester 1)

A reaction vessel equipped with a cooling tube, a stirrer, and a nitrogen introducing tube was charged with dodecanedioic acid (322 parts), 1,6-hexanediol (215 parts), and titanium dihydroxy bis(triethanol aminate) (1 part) as a condensation catalyst, and the materials were reacted at 180° C. for 8 hours under a nitrogen stream with generated water distilled away. Next, the materials were gradually warmed to 220° C., reacted for 4 hours under a nitrogen stream with generated water and 1,6-hexandiol distilled away, and after this, reacted under a reduced pressure reduced by 5 mmHg to 20 mmHg until the weight-average molecular weight became 6,000, to thereby obtain polyester diol.

The obtained polyester diol (269 parts) was changed to another reaction vessel equipped with a cooling tube, a stirrer, and a nitrogen introducing tube, to which ethyl acetate (280 parts) and hexamethylenediisocyanate (HDI) (12.4 parts) were added. The materials were reacted at 80° C. for 5 hours under a nitrogen stream. Next, under a reduced pressure, ethyl acetate was distilled away to obtain Crystalline Urethane-Modified Polyester 1 having a weight-average molecular weight of 160,000, a melting point of 72° C., and a softening temperature of 81° C.

(Synthesis of Crystalline Urethane-Modified Polyester 2)

A reaction vessel equipped with a cooling tube, a stirrer, and a nitrogen introducing tube was charged with sebacic acid (283 parts), 1,6-hexanediol (215 parts), and titanium dihydroxy bis(triethanol aminate) (1 part) as a condensation catalyst, and the materials were reacted at 180° C. for 8 hours under a nitrogen stream with generated water distilled away. Next, the materials were gradually warmed to 220° C., reacted for 4 hours under a nitrogen stream with generated water and 1,6-hexandiol distilled away, and after this, reacted under a reduced pressure reduced by 5 mmHg to 20 mmHg until the weight-average molecular weight became 6,000, to thereby obtain polyester diol.

The obtained polyester diol (249 parts) was changed to another reaction vessel equipped with a cooling tube, a stirrer, and a nitrogen introducing tube, to which ethyl acetate (250 parts) and hexamethylenediisocyanate (HDI) (11 parts) were added. The materials were reacted at 80° C. for 5 hours under a nitrogen stream. Next, under a reduced pressure, ethyl acetate was distilled away to obtain Crystalline Urethane-Modified Polyester 2 having a weight-average molecular weight of 140,000, a melting point of 66° C., and a softening temperature of 84° C.

(Synthesis of Crystalline Urethane-Modified Polyester 3)

A reaction vessel equipped with a cooling tube, a stirrer, and a nitrogen introducing tube was charged with sebacic acid (283 parts), 1,6-hexanediol (215 parts), and titanium dihydroxy bis(triethanol aminate) (1 part) as a condensation catalyst, and the materials were reacted at 180° C. for 8 hours under a nitrogen stream with generated water distilled away. Next, the materials were gradually warmed to 220° C., reacted for 4 hours under a nitrogen stream with generated water and 1,6-hexandiol distilled away, and after this, reacted under a reduced pressure reduced by 5 mmHg to 20 mmHg until the weight-average molecular weight became 6,000, to thereby obtain polyester diol.

The obtained polyester diol (249 parts) was changed to another reaction vessel equipped with a cooling tube, a stirrer, and a nitrogen introducing tube, to which ethyl acetate (250 parts) and hexamethylenediisocyanate (HDI) (9 parts) were added. The materials were reacted at 80° C. for 5 hours under a nitrogen stream. Next, under a reduced pressure, ethyl acetate was distilled away to obtain Crystalline Urethane-Modified Polyester 3 having a weight-average molecular weight of 100,000, a melting point of 66° C., and a softening temperature of 84° C.

(Synthesis of Crystalline Polyester 1)

A reaction vessel equipped with a cooling tube, a stirrer, and a nitrogen introducing tube was charged with sebacic acid (283 parts), 1,6-hexanediol (215 parts), and titanium dihydroxy bis(triethanol aminate) (1 part) as a condensation catalyst, and the materials were reacted at 180° C. for 8 hours under a nitrogen stream with generated water distilled away. Next, the materials were gradually warmed to 220° C., reacted for 4 hours under a nitrogen stream with generated water and 1,6-hexandiol distilled away, and after this, reacted under a reduced pressure reduced by 5 mmHg to 20 mmHg until the weight-average molecular weight became 17,000, to thereby obtain Crystalline Polyester 1 having a melting point of 63° C.

(Synthesis of Crystalline Polyester 2)

A reaction vessel equipped with a cooling tube, a stirrer, and a nitrogen introducing tube was charged with sebacic acid (142 parts), dimethyl terephthalic acid (136 parts), 1,6-hexanediol (215 parts), and titanium dihydroxy bis(triethanol aminate) (1 part) as a condensation catalyst, and the materials were reacted at 180° C. for 8 hours under a nitrogen stream with generated water distilled away. Next, the materials were gradually warmed to 220° C., reacted for 4 hours under a nitrogen stream with generated water and 1,6-hexandiol distilled away, and after this, reacted under a reduced pressure reduced by 5 mmHg to 20 mmHg until the weight-average molecular weight became 10,000, to thereby obtain Crystalline Polyester 2 having a melting point of 52° C.

(Synthesis of Non-Crystalline Polyester 1)

A reaction vessel equipped with a cooling tube, a stirrer, and a nitrogen introducing tube was charged with a bisphenol A propylene oxide 2-mole adduct (215 parts), a bisphenol A ethylene oxide 2-mole adduct (132 parts), a terephthalic acid (126 parts), and tetrabutoxy titanate (18 parts) as a condensation catalyst, and the materials were reacted at 230° C. for 6 hours under a nitrogen stream with generated water distilled away. Next, under a reduced pressure reduced by 5 mmHg to 20 mmHg, the materials were reacted for 1 hour and cooled to 180° C. After this, trimellitic anhydride (8 parts) was added, and the materials were reacted under a reduced pressure reduced by 5 mmHg to 20 mmHg until the weight-average molecular weight became 10,000, to thereby obtain Non-Crystalline Polyester 1 having a glass transition point of 60° C. and a softening temperature of 106° C.

(Melting Point Ta)

Differential scanning calorimeters (DSC) TA-60WS and DSC-60 (manufactured by Shimadzu Corporation) were used to measure the melting point. Specifically, the sample was subjected to melting at 130° C., cooled to 70° C. at a rate of 1.0° C./min, and cooled to 10° C. at a rate of 0.5° C./min. Next, the sample was warmed at a rate of 20°/min, and an endothermic peak temperature present in a range from 20° C. to 100° C. was detected as Ta*. Where there were a plurality of endothermic peaks, the temperature of an endothermic peak at which the amount of heat absorbed was the maximum was detected as Ta*. Then, the sample was stored at (Ta*−10)° C. for 6 hours, and then stored at (Ta*−15)° C. for 6 hours. Then, the sample was cooled to 0° C. at a rate of 10° C./min and warmed at a rate of 20° C./min, and the temperature of a resulting endothermic peak was detected as the melting point Ta. Where there were a plurality of endothermic peaks, the temperature of an endothermic peak at which the amount of heat absorbed was the maximum was detected as the melting point Ta.

(Softening Temperature Tb)

A Kouka-shiki flow tester CFT-500D (manufactured by Shimadzu Corporation) was used to measure the softening temperature. Specifically, while being heated at a temperature elevating rate of 6° C./min, the sample (1 g) was extruded from a nozzle having a diameter of 1 mm and a length of 1 mm, under a load of 1.96 MPa applied by a plunger. The amount of descent of the plunger of the flow tester was plotted relative to the temperature. In this case, the temperature at which the sample had flowed out by half was detected as the softening temperature Tb.

(Glass Transition Point)

A thermal analysis work station TA-60WS and a differential scanning calorimeter DSC-60 (manufactured by Shimadzu Corporation) were used to measure the glass transition point under the conditions described below.

Sample vessel: an aluminum sample pan (with a lid)
Amount of sample: 5 mg
Reference: an aluminum sample pan (alumina: 10 mg)
Atmosphere: nitrogen (flow rate: 50 ml/min)
Starting temperature: 20° C.
Temperature elevating rate: 10° C./min
Ending temperature: 150° C.
Duration for retaining: none
Temperature lowering rate: 10°/min
Ending temperature: 20° C.
Duration for retaining: none
Temperature elevating rate: 10° C./min
Ending temperature: 150° C.

The measurement results were analyzed with data analyzing software TA-60 version 1.52 (manufactured by Shimadzu Corporation). Specifically, first, a range of ±5° C. from the maximum peak was selected from a DrDSC curve, which was a DSC differential curve for the second temperature elevation, and the temperature of the peak was calculated with a peak analyzing function of the analyzing software. Next, a range of ±5° C. from the temperature of the peak was selected from a DSC curve, and the highest endothermic temperature of the DSC curve was calculated with the peak analyzing function of the analyzing software as the glass transition point.

(Weight-Average Molecular Weight)

GPC-8220GPC (manufactured by Tosoh Corporation) and a 15 cm three-serial column TSKGEL SUPER HZM-H (manufactured by Tosoh Corporation) were used to measure the weight-average molecular weight. Specifically, the sample was dissolved in tetrahydrofuran (manufactured by Wako Pure Chemical Industries, Ltd.) containing a stabilizing agent to obtain a 0.15% by mass solution. After this, the solution was filtered with a filter having a pore size of 0.2 μm, and the filtrate was injected in an amount of 100 μL. At this time, the measurement was performed at 40° C. at a flow rate of 0.45 mL/min. The molecular weight of the sample was calculated from the relationship between the count value and the logarithmic value of a standard curve generated based on standard-sample monodisperse polystyrenes. The monodisperse polystyrenes used were ShowdexSTANDARD Std. No S-7300, S-210, S-390, S-875, S-1980, S-10.9, S-629, S-3.0, and S-0.580 (manufactured by Showa Denko K.K.). The detector used was a RI (Refraction Index) detector.

Example 1

Crystalline Urethane-Modified Polyester 3 (40 parts), Non-Crystalline Polyester 1 (55 parts), carnauba wax (with a number-average molecular weight of 1,800, an acid value of 2.7 mgKOH/g, and a needle penetration degree at 40° C. of 1.7 mm) (5 parts), a charge controlling agent E-84 (manufactured by Orient Chemical Industries Co., Ltd.) (1 part) were mixed with a Henschel mixer to obtain a toner composition.

Next, a two-serial-open-roll kneader KNEADEX (manufactured by Mitsui Mining Co., Ltd.) was used to knead the toner composition.

The two-serial-open-roll kneader had a roll outer diameter of 0.14 m, and an effective roll length of 0.8 m. The kneader was run under the conditions that the rotation umber of the heating roll was 35 rpm (with a circumferential velocity of 4.8 m/min), the rotation number of the cooling roll was 29 rpm (with a circumferential velocity of 4.1 m/min), and the gap between the rolls were 0.2 mm. The temperature of the heating medium was set to 125° C. at a side of the heating roll from which the toner composition would be fed and to 75° C. at a side thereof from which the kneaded product would be discharged, and the temperature of the cooling medium was set to 35° C. at a side of the cooling roll from which the toner composition would be fed and to 30° C. at a side thereof from which the kneaded produced would be discharged. The feeding speed of the toner composition was 5 kg/h.

Next, the obtained kneaded product was cooled in the air, and coarsely pulverized with an atomizer, to obtain a coarsely pulverized product having a largest diameter of 2 mm or smaller. The obtained coarsely pulverized product was finely pulverized with a collision-type jet mill IDS5 (manufactured by Nippon Pneumatic Mfg. Co., Ltd.) at a pulverizing air pressure of 0.5 MPa. The obtained finely pulverized product was classified with an air flow classifier DS5 (manufactured by Nippon Pneumatic Mfg. Co., Ltd.), with the goal set to a volume median particle size (D50) of 6.5±0.3 μm, to thereby obtain base particles.

The base particles (100 parts), hydrophobic silica (1 part), and hydrophobized titanium oxide (0.7 part) were mixed with a Henschel mixer to obtain a toner.

Example 2

A toner was obtained in the same manner as Example 1, except that the rotation number of the heating roll was changed to 23 rpm.

Example 3

A toner was obtained in the same manner as Example 1, except that the additive amounts of Crystalline Urethane-Modified Polyester 3 and Non-Crystalline Polyester 1 were changed to 15 parts and 80 parts respectively, and the rotation number of the heating roll was changed to 40 rpm.

Example 4

A toner was obtained in the same manner as Example 3, except that the rotation number of the heating roll was changed to 28 rpm.

Example 5

A toner was obtained in the same manner as Example 1, except that the additive amounts of Crystalline Urethane-Modified Polyester 3 and Non-Crystalline Polyester 1 were changed to 25 parts and 70 parts respectively, and the rotation number of the heating roll was changed to 27 rpm.

Example 6

A toner was obtained in the same manner as Example 5, except that the rotation number of the heating roll was changed to 37 rpm.

Example 7

A toner was obtained in the same manner as Example 5, except that the rotation number of the heating roll was changed to 30 rpm.

Example 8

A toner was obtained in the same manner as Example 5, except that the rotation number of the heating roll was changed to 33 rpm.

Example 9

A toner was obtained in the same manner as Example 7, except that Crystalline Urethane-Modified Polyester 2 was used instead of Crystalline Urethane-Modified Polyester 3.

Example 10

A toner was obtained in the same manner as Example 7, except that Crystalline Urethane-Modified Polyester 1 was used instead of Crystalline Urethane-Modified Polyester 3.

Example 11

A toner was obtained in the same manner as Example 9, except that the rotation number of the heating roll was changed to 35 rpm.

Example 12

A toner was obtained in the same manner as Example 10, except that the rotation number of the heating roll was changed to 35 rpm.

Example 13

A toner was obtained in the same manner as Example 5, except that Crystalline Polyester 2 was used instead of Crystalline Urethane-Modified Polyester 3.

Example 14

A toner was obtained in the same manner as Example 8, except that Crystalline Polyester 2 was used instead of Crystalline Urethane-Modified Polyester 3.

Example 15

A toner was obtained in the same manner as Example 7, except that Crystalline Polyester 1 was used instead of Crystalline Urethane-Modified Polyester 3.

Example 16

A toner was obtained in the same manner as Example 15, except that the rotation number of the heating roll was changed to 35 rpm.

Comparative Example 1

A toner was obtained in the same manner as Example 1, except that the additive amounts of Crystalline Urethane-Modified Polyester 3 and Non-Crystalline Polyester 1 were changed to 45 parts and 50 parts respectively, and the rotation number of the heating roll was changed to 24 rpm.

Comparative Example 2

A toner was obtained in the same manner as Example 1, except that the additive amounts of Crystalline Urethane-Modified Polyester 3 and Non-Crystalline Polyester 1 were changed to 10 parts and 85 parts respectively, and the rotation number of the heating roll was changed to 30 rpm.

Comparative Example 3

A toner was obtained in the same manner as Example 1, except that the additive amounts of Crystalline Urethane-Modified Polyester 3 and Non-Crystalline Polyester 1 were changed to 30 parts and 65 parts respectively, and the rotation number of the heating roll was changed to 45 rpm.

Comparative Example 4

A toner was obtained in the same manner as Comparative Example 3, except that the rotation number of the heating roll was changed to 20 rpm.

The toner manufacturing conditions are shown in Table 1.

TABLE 1

| | Crystalline resin | | Non-crystalline resin | | Rotation |
|---|---|---|---|---|---|
| | Kind | Additive amount [part] | Kind | Additive amount [part] | number of heating roll (rpm) |
| Example 1 | Crystalline Urethane-Modified Polyester 3 | 40 | Non-Crystalline Polyester 1 | 55 | 35 |
| Example 2 | Crystalline Urethane-Modified Polyester 3 | 40 | Non-Crystalline Polyester 1 | 55 | 23 |
| Example 3 | Crystalline Urethane-Modified Polyester 3 | 15 | Non-Crystalline Polyester 1 | 80 | 40 |
| Example 4 | Crystalline Urethane-Modified Polyester 3 | 15 | Non-Crystalline Polyester 1 | 80 | 28 |
| Example 5 | Crystalline Urethane-Modified Polyester 3 | 25 | Non-Crystalline Polyester 1 | 70 | 27 |
| Example 6 | Crystalline Urethane-Modified Polyester 3 | 25 | Non-Crystalline Polyester 1 | 70 | 37 |
| Example 7 | Crystalline Urethane-Modified Polyester 3 | 25 | Non-Crystalline Polyester 1 | 70 | 30 |
| Example 8 | Crystalline Urethane-Modified Polyester 3 | 25 | Non-Crystalline Polyester 1 | 70 | 33 |
| Example 9 | Crystalline Urethane-Modified Polyester 2 | 25 | Non-Crystalline Polyester 1 | 70 | 30 |
| Example 10 | Crystalline Urethane-Modified Polyester 1 | 25 | Non-Crystalline Polyester 1 | 70 | 30 |
| Example 11 | Crystalline Urethane-Modified Polyester 2 | 25 | Non- Crystalline Polyester 1 | 70 | 35 |
| Example 12 | Crystalline Urethane-Modified Polyester 1 | 25 | Non-Crystalline Polyester 1 | 70 | 35 |
| Example 13 | Crystalline Polyester 2 | 25 | Non-Crystalline Polyester 1 | 70 | 27 |
| Example 14 | Crystalline Polyester 2 | 25 | Non-Crystalline Polyester 1 | 70 | 33 |
| Example 15 | Crystalline Polyester 1 | 25 | Non-Crystalline Polyester 1 | 70 | 30 |
| Example 16 | Crystalline Polyester 1 | 25 | Non-Crystalline Polyester 1 | 70 | 35 |
| Comparative Example 1 | Crystalline Urethane-Modified Polyester 3 | 45 | Non-Crystalline Polyester 1 | 50 | 24 |
| Comparative Example 2 | Crystalline Urethane-Modified Polyester 3 | 10 | Non-Crystalline Polyester 1 | 85 | 30 |
| Comparative Example 3 | Crystalline Urethane-Modified Polyester 3 | 30 | Non-Crystalline Polyester 1 | 65 | 45 |
| Comparative Example 4 | Crystalline Urethane-Modified Polyester 3 | 30 | Non-Crystalline Polyester 1 | 65 | 20 |

The physical properties of the toners are shown in Table 2.

TABLE 2

| | Ratio of stained regions in reflected electron image [area %] | | Detected intensity ratio of secondary ions derived from crystalline resin to secondary ions derived from |
|---|---|---|---|
| | Cross-section | Surface | non-crystalline resin |
| Example 1 | 50 | 10 | 0.18 |
| Example 2 | 50 | 40 | 0.18 |
| Example 3 | 80 | 10 | 0.12 |
| Example 4 | 80 | 40 | 0.12 |
| Example 5 | 65 | 35 | 0.15 |
| Example 6 | 65 | 20 | 0.15 |
| Example 7 | 65 | 30 | 0.15 |
| Example 8 | 65 | 25 | 0.15 |
| Example 9 | 65 | 35 | 0.10 |
| Example 10 | 65 | 35 | 0.02 |
| Example 11 | 65 | 25 | 0.10 |
| Example 12 | 65 | 25 | 0.02 |
| Example 13 | 65 | 35 | 0.30 |
| Example 14 | 65 | 25 | 0.40 |
| Example 15 | 65 | 35 | 0.30 |
| Example 16 | 65 | 25 | 0.40 |
| Comparative Example 1 | 45 | 35 | 0.25 |
| Comparative Example 2 | 85 | 35 | 0.17 |
| Comparative Example 3 | 65 | 5 | 0.30 |
| Comparative Example 4 | 65 | 65 | 0.17 |

(Ratio of Stained Regions in Reflected Electron Image of Surface)

After the toner was exposed to a vaporous atmosphere of a ruthenium tetroxide aqueous solution and stained, a reflected electron image of the surface of the toner was captured with a scanning electron microscope S-4800 (manufactured by Hitachi Ltd.) at an accelerating voltage of 2.0 kV. Specifically, the toner was secured on a sample table for electron microscope observation with a carbon tape in a manner that the toner was smoothed into one layer, and after this, without vapor deposition of platinum, a reflected electron image of the toner was captured under the following conditions after flashing.

Signal Name=SE(U, LA80)
Accelerating Voltage=2,000 Volt
Emission Current=10,000 nA
Working Distance=6,000 μm
Lens Mode=High Condenser 1=5
Scan Speed=Slow 4 (40 seconds)
Magnification=600
Data Size=1280×960
Color Mode=Gray scale At this time, from the control software for the scanning electron microscope S-4800 (manufactured by Hitachi Ltd.), the brightness conditions were adjusted to contrast of 5 and brightness of 5, Slow 4, which indicated capture speed/cumulative number of images, was set to 40 seconds, the image size was set to 1280×960 pixels, and the gray scale was set to 8-bit 256 levels. Under these conditions, reflected electron images were captured. With reference to the scale on the image, the length of 1 pixel was 0.1667 μm, and the area of 1 pixel was 0.0278 $\mu m^2$.

Next, the ratio of regions stained by ruthenium tetroxide was calculated for 50 toner particles, based on the obtained reflected electron images.

The ratio of stained regions was calculated with image processing software IMAGE-PRO PLUS 5.1J (manufactured by Media Cybernetics).

First, toner particles were extracted from the reflected electron image, and the size of the particles was counted. Specifically, toner particles were separated from the background in order to extract the target particles to be analyzed. On the IMAGE-PRO PLUS 5.1J, "measurement" and "count/size" were selected, and the luminance range was set to be from 50 to 255 on "luminance range selection" of "count/size", in order to extract toner particles while excluding the lower-luminance carbon tape regions that were captured in the image as the background.

For extracting toner particles, extraction options for "count/size" were filled in by selecting a merging number of 4, entering a smoothing level of 5, and checking "fill any openings", and toner particles located on any of the boundaries (outer circumference) of the reflected electron image or toner particles overlapping other toner particles were excluded.

Next, from the measurement options for "count/size", area and Feret diameters (average) were selected, and the area range was set to be from 300 pixels at the minimum to 10,000,000 pixels at the maximum.

The Feret diameter (average) range was set to ±25% of a volume median particle size (D50) of the toner measured by Coulter counter method, in order to extract the target toner particles to be subjected to image analysis.

One particle was selected from the extracted particles, and the size (pixel count) ja of the particle was measured.

Next, on "luminance range selection" of "count/size" of the IMAGE-PRO PLUS 5.1J, the luminance range was set to be from 50 to 255, in order to extract stained regions.

At this time, the area range was selected to be from 10 pixels at the minimum to 10,000 pixels at the maximum. The size (pixel count) ma of a stained region of the particle of which ja value had been measured was measured.

The same process was repeated until the number of particles selected from the extracted particles was cumulated to 50. If it was the case that the number of particles that were captured from one view field is less than 50, the same process would be performed for another view field.

Next, the ratio of stained regions was calculated from the formula (Ma/Ja)×100, where Ma indicates the total of the ma values of the 50 particles, and Ja indicates the total of the ja values of the 50 particles.

(Ratio of Stained Regions in Reflected Electron Image of Cross-Section)

After the toner was buried and hardened in an epoxy resin, it was fixed and held on a support. Next, a cross-sectional thin section of the toner was cut out from about the center of the toner with an ultramicrotome RM2265 (manufactured by Leica).

The ratio of stained regions in the reflected electron image of the cross-section was calculated in the same manner as calculating the ratio of stained regions in the reflected electron image of the surface, except for using the cross-sectional thin section of the toner cut out from about the center of the toner instead of a toner particle.

(Detected Intensity Ratio of Secondary Ions Derived from Crystalline Resin to Secondary Ions Derived from Non-Crystalline Resin)

The detected intensity ratio of secondary ions derived from the crystalline-resin to secondary ions derived from the non-crystalline resin was measured with a time-of-flight secondary ion mass spectrometer TRIFT-3 (manufactured by ULVAC-PHI) under the conditions described below.

Primary ion source: Ga

Measured area: 100×100 $\mu m^2$

Secondary ion polarity: negative

Prioritized resolution: mass

Ga accelerating voltage: 15 kV

The analysis was conducted by dispersing the toner in ethyl acetate and coating an Ag substrate with the obtained dispersed product. GC-MS, NMR, and X-ray diffractometry were used to confirm the crystalline resin and the non-crystalline resin in the toner and calculate the detected intensity ratio between the secondary ions derived from both the resins.

Next, the lower-limit fixing temperature, toner scattering, and background smear were evaluated with the toner.

(Lower-Limit Fixing Temperature)

With an electrophotographic copier (MF-200 manufactured by Ricoh Company Ltd.) which was equipped with a Teflon (Registered Trademark) fixing roller and of which fixing unit was modified, a one-tone image having an image size of 3 cm×8 cm was formed on a copier/printer sheet <70> (manufactured by Ricoh Business Expert Co., Ltd.), with an amount of toner deposited being 0.85±0.1 mg/$cm^2$, and fixed thereon with the temperature of the fixing belt changed. Next, with a drawing tester AD-401 (manufactured by Ueshima Seisakusho Co., Ltd.), drawing was applied to the surface of the fixed image with a ruby needle having a tip radius of 260 μm to 320 μm and a tip angle of 60° under a load of 50 g. After this, the drawing-applied surface of the fixed image was strongly scraped 5 times with fabric HANIKOTTO #440 (manufactured by Haneron Corporation Ltd.), and the temperature of the fixing belt at which almost no more scraping scraps of the image would be produced was determined as the lower-limit fixing temperature. At this time, the one-tone image was formed at a position 3.0 cm away from an end of the sheet in the sheet passing direction, and the sheet was passed through the nip portion of the fixing unit at a speed of 280 mm/s.

(Toner Scattering)

With a digital full-color copier IMAGIO COLOR 2800 (manufactured by Ricoh Company Ltd.), 50,000 image charts having an image occupation rate of 50% were output in one run in a single-color mode. After this, the level of toner contamination inside the copier was evaluated. Toners with an acceptable toner contamination level were graded A. Toners, which were slightly found out of place in the copier but would cause no trouble in use, were graded B. Toners, which did contaminate the copier but would cause no trouble in use, were graded C. Toners, which contaminated the copier noticeably and would cause troubles, were graded D.

(Background Smear)

With IPSIO CX2500 (manufactured by Ricoh Company Ltd.), a print pattern with a B/W (Black/White) ratio of 6% was printed on 2,000 sheets serially at 23° C. at 45 RH %. Then, a no-color transparent tape was pasted on a portion of the photoconductor that had been developed but had not been cleaned, and a tape was pasted on a white sheet. Then, with a spectroscopic densitometer XRITE 939 (manufactured by X-Rite), the luminosity (L*) on the white sheet was measured to evaluate background smear. Toners resulting in a luminosity of 90 or higher were graded A, toners resulting in a luminosity of 85 or higher but lower than 90 were graded B, toners resulting in a luminosity of 80 or higher but lower than 85 were graded C, and toners resulting in a luminosity of lower than 80 were graded D.

Table 3 shows the results of the evaluations on toner scattering and background smear.

TABLE 3

| | Lower-limit fixing temperature [° C.] | Toner scattering | Background smear |
|---|---|---|---|
| Example 1 | 105 | C | C |
| Example 2 | 125 | B | B |
| Example 3 | 105 | C | C |
| Example 4 | 125 | B | B |
| Example 5 | 125 | B | B |
| Example 6 | 110 | B | B |
| Example 7 | 115 | B | B |
| Example 8 | 120 | B | B |
| Example 9 | 125 | A | A |
| Example 10 | 125 | A | A |
| Example 11 | 110 | A | A |
| Example 12 | 110 | A | A |
| Example 13 | 125 | C | C |
| Example 14 | 115 | C | C |
| Example 15 | 125 | C | C |
| Example 16 | 115 | C | C |
| Comparative Example 1 | 120 | D | D |
| Comparative Example 2 | 140 | C | C |
| Comparative Example 3 | 105 | D | D |
| Comparative Example 4 | 140 | C | C |

From Table 3, it can be seen that the toners of Examples 1 to 16 had excellent low-temperature fixability and were able to prevent toner scattering and background smear.

As compared with this, the toner of Comparative Example 1, of which ratio of stained region in the reflected electron image of the cross-section was 45 area %, caused toner scattering and background smear.

The toner of Comparative Example 2, of which ratio of stained regions in the reflected electron image of the cross-section was 85 area %, had a poor low-temperature fixability.

The toner of Comparative Example 3, of which ratio of stained regions in the reflected electron image of the surface was 5 area %, caused toner scattering and background smear.

The toner of Comparative Example 4, of which ratio of stained regions in the reflected electron image of the surface was 65 area %, had a poor low-temperature fixability.

REFERENCE SIGNS LIST

10 photoconductor
20 developing device
100 process cartridge
110 photoconductor
130 developing device

The invention claimed is:

1. A toner, comprising:

a crystalline resin; and a non-crystalline resin, wherein in a reflected electron image, captured by a scanning electron microscope, of a cross-section of the toner stained by ruthenium tetroxide, a ratio of regions stained by the ruthenium tetroxide is from 50 area % to 80 area %, and wherein in a reflected electron image, captured by a scanning electron microscope, of a surface of the toner stained by ruthenium tetroxide, a ratio of regions stained by the ruthenium tetroxide is from 10 area % to 40 area %.

2. The toner according to claim 1, wherein in the reflected electron image of the surface, the ratio of regions stained by the ruthenium tetroxide is from 20 area % to 30 area %.

3. The toner according to claim 1, wherein a ratio of a detected intensity of secondary ions derived from the crystalline resin to a detected intensity of secondary ions derived from the non-crystalline resin is 0.10 or less, where the intensities are measured by time of flight secondary ion mass spectroscopy.

4. The toner according to claim 1, wherein the crystalline resin is a crystalline urethane-modified polyester.

5. A developer, comprising:

the toner according to claim 1.

6. An image forming apparatus, comprising:

a photoconductor;

a charging unit configured to electrically charge the photoconductor;

an exposure unit configured to expose the electrically charged photoconductor to form an electrostatic latent image thereon;

a developing unit containing a developer and configured to develop the electrostatic latent image formed on the photoconductor with the developer to form a toner image;

a transfer unit configured to transfer the toner image formed on the photoconductor to a recording medium; and a fixing unit configured to fix the toner image transferred to the recording medium, wherein the developer is the developer according to claim 5.

7. A process cartridge, comprising:

a photoconductor; and a developing unit containing a developer and configured to develop an electrostatic latent image formed on the photoconductor with the developer to form a toner image, wherein the process cartridge is attachable to and detachable from a body of an image forming apparatus, and wherein the developer is the developer according to claim 5.

* * * * *